US011549746B2

(12) United States Patent
Irisawa

(10) Patent No.: US 11,549,746 B2
(45) Date of Patent: Jan. 10, 2023

(54) NATURAL GAS LIQUEFACTION DEVICE AND NATURAL GAS LIQUEFACTION METHOD

(71) Applicant: TAIYO NIPPON SANSO CORPORATION, Tokyo (JP)

(72) Inventor: Makoto Irisawa, Tokyo (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 42 days.

(21) Appl. No.: 16/981,135

(22) PCT Filed: Mar. 25, 2019

(86) PCT No.: PCT/JP2019/012449
§ 371 (c)(1),
(2) Date: Sep. 15, 2020

(87) PCT Pub. No.: WO2019/188957
PCT Pub. Date: Oct. 3, 2019

(65) Prior Publication Data

US 2021/0048243 A1 Feb. 18, 2021

(30) Foreign Application Priority Data

Mar. 27, 2018 (JP) ..... JP2018-060261

(51) Int. Cl.
*F25J 1/02* (2006.01)
*F25J 1/00* (2006.01)
*F25B 11/02* (2006.01)

(52) U.S. Cl.
CPC ..... *F25J 1/0022* (2013.01); *F25B 11/02* (2013.01); *F25J 1/0052* (2013.01); *F25J 1/0057* (2013.01);

(Continued)

(58) Field of Classification Search
CPC ..... F25J 1/0022; F25J 1/0216; F25J 1/0218; F25J 1/0025; F25J 1/0205; F25J 1/0204; F25J 2270/60
See application file for complete search history.

(56) References Cited

U.S. PATENT DOCUMENTS 3,818,714 A 6/1974 Etzbach et al.
4,843,829 A 7/1989 Stuber et al.
(Continued)

FOREIGN PATENT DOCUMENTS

JP 02-106688 4/1990
JP 02-157583 6/1990
(Continued)

OTHER PUBLICATIONS

International Search Report for PCT/JP2019/012449 dated Jun. 25, 2019, 3 pages.
(Continued)

*Primary Examiner* — Brian M King
(74) *Attorney, Agent, or Firm* — Nixon & Vanderhye P.C.

(57) ABSTRACT

One object of the present invention is to provide a natural gas liquefaction device which uses noncombustible gas as a refrigerant, and can reduce the power consumption a range of relatively low refrigerant pressure, and the present invention provides a natural gas liquefaction device including a compressor which is configured to compress a refrigerant containing noncombustible gas by a plurality of compression stages; a heat exchanger which is configured to cool and liquefy a natural gas to be a liquefied natural gas; a natural gas liquefaction line which is configured to introduce the natural gas into the heat exchanger and supply the liquefied natural gas to an outside; a first refrigerant line which is configured to introduce a refrigerant-1 passed through the compressor into the heat exchanger, and then further introduce the refrigerant-1 into a decompressor; a second refrig- (Continued)

erant line which is configured to introduce the refrigerant-2 decompressed by the decompressor into the heat exchanger, and further introduce the refrigerant-2 into any one of a second compression stage and subsequent stages of the compressor; a third refrigerant line which is configured to be branched from the first refrigerant line and introduce at least a part of the refrigerant-1 into an expansion turbine; and a fourth refrigerant line which is configured to introduce the refrigerant-3 expanded by the expansion turbine into the heat exchanger, and further introduce the refrigerant-3 into a first compression stage of the plurality of compression stages provided in the compressor.

12 Claims, 4 Drawing Sheets

(52) U.S. Cl.
CPC ..... *F25J 1/0072* (2013.01); *F25J 1/0205* (2013.01); *F25J 2270/90* (2013.01)

(56) References Cited

U.S. PATENT DOCUMENTS 4,846,862 A * 7/1989 Cook ..... F25J 1/0025 62/48.2
2009/0019888 A1* 1/2009 Bauer ..... F25J 1/0214 62/614
2010/0147024 A1* 6/2010 Roberts ..... F25J 1/0085 62/612
2011/0113825 A1* 5/2011 Neeraas ..... F25J 1/0072 62/613
2011/0203312 A1* 8/2011 Jakobsen ..... F25J 1/005 62/613
2014/0190205 A1* 7/2014 Bonnissel ..... F25J 1/0212 62/614
2017/0370639 A1* 12/2017 Bardon ..... F25J 1/0022
2019/0242651 A1* 8/2019 Granados ..... F28D 9/0068

FOREIGN PATENT DOCUMENTS

JP 5647299 12/2014
JP 2015-501410 1/2015
WO 2013/057314 4/2013

OTHER PUBLICATIONS

Roberts et al., "Brayton refrigeration cycles for small-scale LNG", Gas Processing, Jul./Aug. 2015, pp. 27-32.

* cited by examiner

RELATIONSHIP BETWEEN PRESSURE AT INLET OF EXPANSION TURBINE AND POWER CONSUMPTION OF COMPRESSOR

NATURAL GAS LIQUEFACTION DEVICE AND NATURAL GAS LIQUEFACTION METHOD

This application is the U.S. national phase of International Application No. PCT/JP2019/012449 filed Mar. 25, 2019 which designated the U.S. and claims priority to JP Patent Application No. 2018-060261 filed Mar. 27, 2018, the entire contents of each of which are hereby incorporated by reference.

TECHNICAL FIELD

The present invention relates to a natural gas liquefaction device and a natural gas liquefaction method.

BACKGROUND ART

As one method of liquefying natural gas and supplying it as liquefied natural gas (hereinafter, also referred to as "LNG"), a method is known in which noncombustible gas such as nitrogen is used as a refrigerant, and natural gas is cooled and liquefied by the refrigerant expanded by an expansion turbine. Such a method is mainly adopted in a small-scale liquefaction device. There may be a case in which a plurality of expansion turbines are provided, but particularly in a small-scale liquefaction device, a configuration that has only one expansion turbine is adopted.

Non-Patent Document 1, FIG. 4, left figure shows the simplest conventional process in which nitrogen, which is a refrigerant for cooling natural gas, is expanded and cooled by one expansion turbine and introduced into a heat exchanger to cool and liquefy natural gas.

In addition, FIG. 4, right figure shows a conventional process in which the performance (power consumption) is improved as compared with the figure on the left side. In this process, in addition to cooling the natural gas using nitrogen of which the temperature has been lowered using one expansion turbine, the nitrogen is decompressed using a Joule-Thomson valve (hereinafter sometimes referred to as JT valve), and the natural gas is further cooled by using liquid nitrogen of which the pressure has been reduced a lower temperature region.

According to the process shown in Non-Patent Document 1, FIG. 4, right figure, compared with the process shown in the left figure, the temperature at the inlet of the expansion turbine can be increased, so that the flow rate of the refrigerant can be reduced and the power consumption of the compressor for compressing the refrigerant can be reduced.

In the process shown in Non-Patent Document 1, FIG. 4, right figure, when the conditions are determined so as to minimize the power consumption, it is necessary to increase the pressure of the refrigerant (nitrogen) system. Therefore, when designing the device, it is necessary to set the design pressure of a pipe and the like high, and the specifications of the compressor and the heat exchanger used in the device are limited to models with high withstand voltage. Therefore, there are problems in that it is difficult to downsize the device and the cost of the device increases. Also, if the pressure is set low to avoid these problems, there is a problem in that the power consumption will increase significantly.

Patent Document 1 discloses a process using a mixture of nitrogen and methane as a refrigerant in the process disclosed in FIG. 4, right figure of Non-Patent Document 1. The invention disclosed in Patent Document 1 aims to reduce the required energy for liquefaction by using the refrigerant above, as compared with the case of using a refrigerant consisting of only nitrogen. However, in Patent Document 1, since the refrigerant containing methane, which is a combustible substance, is used, the cost to make a safe refrigerant system increases as compared with the case in which only nitrogen, which is a noncombustible gas, is used as the refrigerant.

Further, in the field of liquefaction technology of natural gas, for example, as disclosed in Patent Document 2, many proposals have been made on a technology that divides a refrigerant into different pressure systems and returns into the compressor. Specifically, as shown in FIG. 1 of Patent Document 2, the liquefaction method according to claim 5 of Patent Document 2 comprises compressing a second expanded gaseous refrigerant flow (174) in a second compressor (130), and mixing the second expanded gaseous refrigerant flow (174) with a first portion (154) and a second portion (160) from a first expanded gaseous refrigerant steam (152). Patent Document 2 discloses that the purpose of adopting the configuration above is to reduce the power consumption of a compressor by introducing a gaseous refrigerant stream from an outlet of the high-temperature expander at high pressure into a stage of a gaseous refrigerant compressor, while achieving a low temperature by lowering a discharge pressure of a low-temperature expander lower than a discharge pressure of a high-temperature expander.

However, according to Examples and FIG. 3 of Patent Document 2, the flow rate of the high-pressure refrigerant compressor (132) is 217,725 Ibmol/hour, which is the total of 21,495 Ibmol/hour and 196,230 Ibmol/hour. In contrast, the flow rate of the low-pressure refrigerant compressor (130) is 53,091 Ibmol/hour, which is the same as the flow rate of the upstream flow (170), which is as small as 24% of the flow rate of the high-pressure refrigerant compressor (132). For this reason, it is difficult to integrate these two compressors due to the large difference in the flow rate, so that a plurality of compressors are used, and there is a problem in that the installation area and cost increase.

Further, in the technique disclosed in Patent Document 2, since the ratio of the flow rate of the flow (170) is small as described above, the flow rate of the expander (138) and the low-pressure refrigerant compressor (130) are extremely small in a small-scale device. However, this technology cannot be applied because such a small model does not exist in the market as yet.

PRIOR ART DOCUMENTS

Patent Documents

| | |
|---|---|
| Patent Document 1 | U.S. Pat. No. 3,818,714 |
| Patent Document 2 | Japanese Patent No. 5647299 |

Non-Patent Documents

Non-Patent Document 1 M. Roberts (APCI) et al. "Brayton refrigeration cycles for small-scale LNG" Gas Processing July/August 2015, P27-32

SUMMARY OF INVENTION

Problem to be Solved by the Invention

A general refrigerant system in which the refrigerant returns to the compressor in one system is shown in FIG. 3.

FIG. 3 shows the refrigerant system disclosed in Patent Document 1 and FIG. 4, right figure in Non-Patent Document in more detail.

As shown in FIG. 3, a compressor for compressing a refrigerant generally employs a multi-stage compression configuration in which a plurality of compressors are connected in series. A refrigerant such as nitrogen compressed in a plurality of compression stages is introduced into a heat exchanger through a braking blower as needed, and is used for cooling and liquefying natural gas. The refrigerant that has passed through the heat exchanger is decompressed by a decompressor, introduced again into the heat exchanger, subjected to heat exchange again, and then introduced into a first stage of the plurality of compression stages. On the other hand, a part of the refrigerant compressed in the plurality of compression stages is introduced into an expansion turbine, the expanded refrigerant is combined with the refrigerant decompressed in the decompressor in the heat exchanger, and after heat exchange, is returned to the first compression stage similar to the other part of the refrigerant above.

More specifically, first, in the natural gas liquefaction device 100, after the components that solidify at low temperature and the components that cause corrosion are removed from the natural gas G stored in the natural gas supply source 106, the natural gas G is cooled by the precooler 107 and then introduced into the heat exchanger 104 that liquefies the natural gas G, the natural gas G stored in the natural gas supply source 106 is introduced into the heat exchanger 104 after components that solidify at low temperature and components that cause corrosion are removed, and cooled by the precooler 107. At this time, the pressure of the natural gas introduced into the heat exchanger 104 is about 1 to 8 MPa, and is usually set to about 3 to 6 MPa in consideration of power consumption and design pressure. The temperature of the natural gas G introduced into the heat exchanger 104 is generally room temperature (about 20° C. to 40° C.), or the temperature (about −20° C. to about −50° C.) which is auxiliary (preliminarily) cooled by a refrigerator or the like.

The natural gas G introduced into the heat exchanger 104 is cooled and liquefied by heat exchange with the refrigerant containing low-temperature nitrogen or the like, and becomes LNG. At this time, although it depends on the composition and pressure of the natural gas G, liquefaction starts at a low temperature of about −50° C. and complete liquefaction occurs at about −100° C. The temperature of the LNG discharged from the heat exchanger 104 is as low as possible in order to reduce the amount of vaporization when introduced into the low-pressure storage tank 108, and ideally is about −160° C.

On the other hand, in the nitrogen gas system, the nitrogen gas used as the refrigerant is introduced from the refrigerant source 101 into the compressor 102 having a plurality of compression stages and compressed to, for example, about 3 MPa to 6 MPa. The compressor 102 includes the plurality of compression stages 102A to 102D and coolers 121A to 121D respectively arranged on the outlet side of each compression stage.

The refrigerant which is compressed nitrogen gas is further compressed by the braking blower 131 driven by the expansion turbine 103, and then a part thereof is introduced into the expansion turbine 103. There are also cases in which the refrigerant which is compressed nitrogen gas is introduced into an expansion turbine braked by a generator or an expansion turbine built in a compressor. In any case, the power generated in the expansion turbine 103 is used to compress the nitrogen gas.

The pressure of the nitrogen (refrigerant) introduced into the heat exchanger 104 is higher than the critical pressure (3.4 MPa), and is determined in consideration of the consumption power of the natural gas liquefaction device, the design pressure, and the like.

The nitrogen introduced into the heat exchanger 104 is cooled by heat exchange with the low-temperature nitrogen, a part thereof is extracted at about −50° C. and introduced into the expansion turbine 103, and the residue is further cooled in the heat exchanger 104.

The nitrogen introduced into the expansion turbine 103 becomes approximately −140° C. due to isentropic expansion, and is returned into the heat exchanger 104.

The cooled residual nitrogen introduced into the heat exchanger 104 is introduced into a pressure reducer 105 equipped with a JT valve or a liquid turbine (Liquid expander, Dense fluid expander), and reduced in pressure by the decompressor 105, and becomes a gas-liquid two-phase flow or a liquid phase flow. As a result, the nitrogen after being decompressed by the decompressor 105 is returned into the heat exchanger 104 at a temperature lower than that of the nitrogen at the outlet of the expansion turbine 103, ideally lower than −160° C. to cool the natural gas G and nitrogen, and vaporizes itself to a temperature equivalent to the temperature of the outlet of the expansion turbine 103.

The nitrogen that has reached the same temperature as the outlet of the expansion turbine 103 merges with the nitrogen from the expansion turbine 103 and is used for cooling the natural gas G and nitrogen, and returns to the inlet of the first compression stage 102A of the compressor 102 at room temperature. Therefore, the nitrogen at the outlet of the expansion turbine 103 and the nitrogen at the outlet of the decompressor 105 have the same pressure.

In order to cool the natural gas G to about −160° C. by the nitrogen vaporized at the outlet of the decompressor 105, the boiling point of the nitrogen needs to be lower than −160° C. Therefore, the pressure of the nitrogen at the outlet of the decompressor 105 cannot be higher than about 1.3 MPa. On the other hand, if the pressure of the nitrogen is lower than about 1.3 MPa, the pressure at the inlet of the compressor 102 becomes low and the power consumption increases, so the pressure at the outlet of the decompressor 105 is preferably as high as possible, that is, about 1.3 MPa.

When the pressure at the outlet of the decompressor 105 is 1.3 MPa and the pressure at the outlet of the compressor 102 is increased, the power consumption decreases accordingly. The power consumption becomes minimum when the pressure at the outlet of the compressor 102 is about 6 MPa and the pressure at the inlet of the expansion turbine 103 is about 11 MPa. However, such pressure is considerably high as a design condition of the compressor 102 and the heat exchanger 104. The design pressure becomes high, so that the types of compressors and heat exchangers that can handle such high pressure are limited. For this reason, for example, it is inevitable that a heat exchanger having a high withstand voltage is adopted. It may be difficult to make a small-scale natural gas liquefaction device for the reasons described below.

For example, an aluminum plate fin-type heat exchanger is generally used as a heat exchanger for a small-scale device. When adopting a high-pressure resistant aluminum plate fin-type heat exchanger, although it has a simple structure and excellent strength, it is unavoidable to use a plain fin-type with low heat transfer performance.

When the pressure of the refrigerant system is lowered, a serrated fin-type or a herringbone fin-type with high heat transfer performance can be adopted, and the performance and size of the heat exchanger can be improved.

When the design conditions of the heat exchanger are the same, the heat transfer area of the plain fin-type heat exchanger is about 1.5 to 2 times that of the serrated fin-type heat exchanger. Therefore, when the plane fin-type is adopted, it is difficult to downsize the device.

In order to downsize the device and reduce the device cost, it is necessary to reduce the pressure and increase the choice of each device. However, if the pressure at the inlet of the compressor 102 is increased while the pressure at the outlet of the decompressor 105 is kept to 1.3 MPa, the expansion ratio of the expansion turbine 103 becomes small and the flow rate increases. Furthermore, since the expansion ratio becomes smaller, the temperature at the outlet of the expansion turbine 103 also becomes higher. The amount of heat for lowering the temperature at the outlet of the expansion turbine 103 to −160° C. increases, and the flow rate in the decompressor 105 also increases. Therefore, there is a problem in that the power consumption of the compressor 102 increases.

On the other hand, if the pressure at the outlet of the expansion turbine 103 is decreased to increase the expansion ratio, the pressure at the outlet of the decompressor 105 also decreases at the same time. Therefore, there is a problem in that unnecessary power is required to compress the nitrogen having a low pressure passing through the decompressor 105.

The present invention has been made in view of the above problems, and the object of the present invention is to provide a natural gas liquefaction device and a natural gas liquefaction method which uses noncombustible gas as a refrigerant, and can reduce the power consumption in a range of relatively low refrigerant pressure.

Means for Solving the Problem

In order to solve the problems above, the present invention provides the following natural gas liquefaction devices.

(1) A natural gas liquefaction device which produces a liquefied natural gas by cooling and liquefying a natural gas, wherein the natural gas liquefaction device includes:

a compressor which is configured to compress a refrigerant containing noncombustible gas by a plurality of compression stages;

a heat exchanger which is configured to cool and liquefy a natural gas to be a liquefied natural gas;

a natural gas liquefaction line which is configured to introduce the natural gas into the heat exchanger and supply the liquefied natural gas liquefied in the heat exchanger to an outside;

a first refrigerant line which is configured to introduce a refrigerant compressed by the compressor into the heat exchanger, and further introduce the refrigerant passed through the heat exchanger into a decompressor;

a second refrigerant line which is configured to introduce the refrigerant decompressed by the decompressor into the heat exchanger, and introduce the refrigerant passed through the heat exchanger into any one of a second compression stage and subsequent stages of the plurality of compression stages provided in the compressor;

a third refrigerant line which is configured to be branched from the first refrigerant line and introduce at least a part of the refrigerant into an expansion turbine; and a fourth refrigerant line which is configured to introduce the refrigerant expanded by the expansion turbine into the heat exchanger, and introduce the refrigerant passed through the heat exchanger into a first compression stage of the plurality of compression stages provided in the compressor.

(2) The natural gas liquefaction device according to (1) above, wherein the natural gas liquefaction device further includes a braking blower which is provided in the first refrigerant line, configured to be driven by the expansion turbine, and compress the refrigerant flowing through the first refrigerant line.

(3) The natural gas liquefaction device according to (1) or (2) above, wherein the heat exchanger is an aluminum plate fin-type heat exchanger including serrated fin-type fins or herringbone fin-type fins.

(4) The natural gas liquefaction device according to any one of (1) to (3) above, wherein the natural gas liquefaction device further includes a precooler which is provided on an inlet side of the heat exchanger in the natural gas liquefaction line and configured to cool the natural gas with a vaporization type refrigerant.

(5) The natural gas liquefaction device according to any one of (1) to (4) above, wherein the heat exchanger is divided into a plurality of parts at least at a position at which the refrigerant-3 is introduced into the heat exchanger.

(6) The natural gas liquefaction device according to any one of (1) to (5) above, wherein the natural gas liquefaction device includes a plurality of the decompressors, and a plurality of the second refrigerant lines having different starting points of the refrigerant flow at different decompressors and different ending points of the refrigerant flow at different compression stages of the second compression stage and the subsequent stages.

In order to solve the problems above, the present invention further provides the following natural gas liquefaction methods.

(7) A natural gas liquefaction method for producing a liquefied natural gas by cooling and liquefying a natural gas including:

a natural gas supply step of introducing a natural gas into a heat exchanger, and supplying a liquefied natural gas cooled and liquefied by the heat exchanger to an outside; and a refrigerant supply step of introducing a refrigerant containing noncombustible gas for cooling the natural gas introduced into the heat exchanger; and the refrigerant supply step includes:

a refrigerant supply step a of introducing a refrigerant obtained by compressing a noncombustible gas by a compressor having a plurality of compression stages into the heat exchanger, and introducing the refrigerant passed through the heat exchanger into the decompressor;

a refrigerant supply step b of introducing the refrigerant reduced in temperature by decompression/expansion by the decompressor and at least a part of which is in the liquid phase, into the heat exchanger, and introducing the refrigerant passed through the heat exchanger and heated into any one of a second compression stage and subsequent stages of the plurality of compression stages provided in the compressor;

a refrigerant introducing step c of introducing at least a part of the refrigerant in the refrigerant supply step a into the expansion turbine; and a refrigerant supplying step d of introducing the refrigerant expanded and reduced in pressure and temperature by the expansion turbine into the heat exchanger, and introducing the refrigerant passed through the heat exchanger and heated into the first compression stage of the plurality of compression stages provided in the compressor.

(8) The natural gas liquefaction method according to (7) above, wherein pressure on the inlet side of the expansion turbine in the refrigerant supply step a is less than 9 MPa.

(9) The natural gas liquefaction method according to (7) or (8) above, wherein the refrigerant supply step a further includes a step of further compressing the refrigerant compressed in multiple stages in the compressor using power generated by the expansion turbine.

(10) The natural gas liquefaction method according to any one of (7) to (9) above, wherein the natural gas supply step further includes a step of precooling the natural gas by a vaporization type refrigerant before being introduced into the heat exchanger.

(11) The natural gas liquefaction method according to claim 7, wherein the refrigerant-3 is divided into a plurality of parts and introduced them in the heat exchanger.

(12) The natural gas liquefaction method according to any one of (7) to (11) above, wherein the refrigerant is supplied into a plurality of the decompressors in the refrigerant supply step, and the refrigerant supply step b has different starting points of the refrigerant flow at different decompressors and different ending points of the refrigerant flow at different compression stages of the second compression stage and the subsequent stages.

Effects of the Invention

The natural gas liquefaction device according to the present invention includes the second refrigerant line which is configured to introduce the refrigerant-2, which has compressed by the plurality of compression stages in the compressor, decompressed by the decompressor, and passed through the heat exchanger, into any one of the second compression stage and the subsequent stages of the plurality of compression stages provided in the compressor, and the fourth refrigerant line which is configured to introduce the refrigerant-3, which has expanded by the expansion turbine and passed through the heat exchanger, into the first compression stage in the compressor.

That is, the refrigerant-3 returned at a relatively low pressure from the heat exchanger is introduced into the first compression stage in the compressor. On the other hand, the refrigerant-2 returned at a relatively high pressure from the heat exchanger is introduced into any one of the second compression stage and the subsequent stages of the plurality of compression stages. Therefore, it is possible to reduce the power consumption particularly in a range in which the pressure at the inlet of the expansion turbine is relatively low.

As a result, a heat exchanger which has a high heat transfer performance and a low pressure specification can be used as the heat exchanger. In addition, it is possible to reduce the size and cost of the entire device.

Further, as will be described in detail in Examples below, when the flow rate of the entire refrigerant is 100%, the flow rate of the refrigerant in the second refrigerant line is less than 10%. Therefore, the flow rate of the refrigerant introduced into the preceding compression stage to the compression stage to which the refrigerant is introduced from the second refrigerant line is about 90% when the flow rate of the entire refrigerant is 100%. In this way, the flow rate difference between the compressors becomes small, and it becomes easy to design these compression stages as an integral compressor.

Furthermore, when a pressure-reducing valve is used as the decompressor, it can be applied to a small-scale device in which the flow rate of the second reliable line is small.

In the natural gas liquefaction method according to the present invention, the refrigerant supply step includes the refrigerant supply step b of introducing the refrigerant-2 reduced in temperature by decompression/expansion by the decompressor and at least a part of which is in the liquid phase, into the heat exchanger, and introducing the refrigerant-2 passed through the heat exchanger and heated into any one of the second compression stage and the subsequent stages of the plurality of compression stages provided in the compressor, and the refrigerant supplying step d of introducing the refrigerant-3 expanded and reduced in pressure and temperature by the expansion turbine into the heat exchanger, and introducing the refrigerant-3 passed through the heat exchanger and heated into the first compression stage of the plurality of compression stages provided in the compressor.

As a result, as described above, the refrigerant-3 returned at a relatively low pressure from the heat exchanger is introduced into the first compression stage in the compressor. On the other hand, the refrigerant-2 returned at a relatively high pressure from the heat exchanger is introduced into any one of the second compression stage and the subsequent stages of the plurality of compression stages. Therefore, it is possible to reduce the power consumption particularly in a range in which the pressure at the inlet of the expansion turbine is relatively low.

As a result, it is possible to reduce the size of the device used and operating cost.

DETAILED DESCRIPTION OF THE PREFERRED EMBODIMENTS

Figure 1:
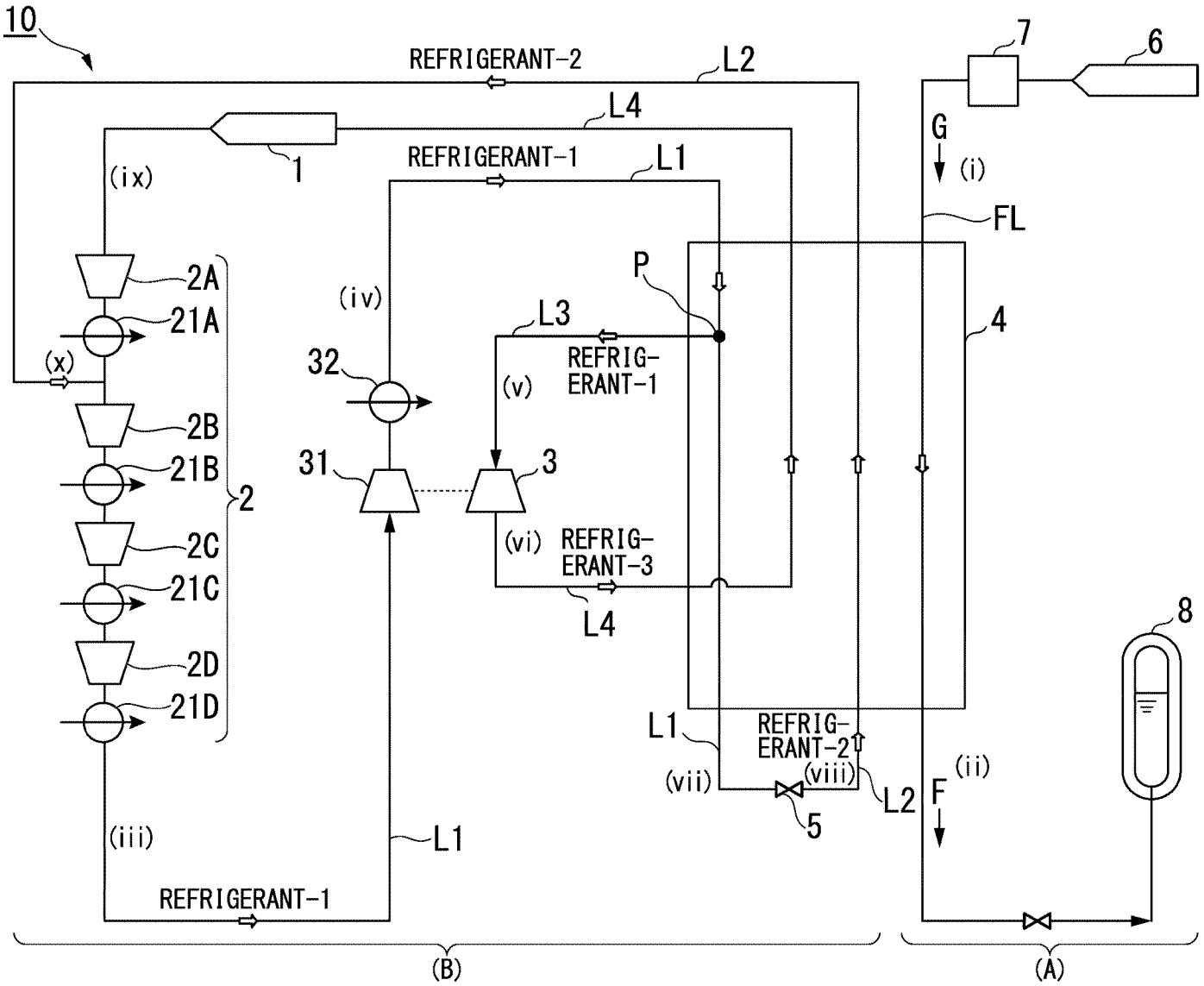
FIG. 1 is a diagram schematically showing a natural gas liquefaction device and a natural gas liquefaction method according to an embodiment of the present invention, and is a system diagram showing a configuration of the entire device.

Hereinafter, a natural gas liquefaction device and a natural gas liquefaction method as one embodiment according to the present invention will be described with reference to FIGS. 1 and 2 as appropriate (also refer to the conventional diagram of FIG. 3 as appropriate). In the drawings used in the following description, in order to make the features easy to understand, there are cases where features are enlarged for convenience, and it is not always the case that the dimensional ratios of the components are the same as the actual ones. Further, the materials and the like exemplified in the following description are examples, and the present invention is not limited thereto, and can be appropriately modified and carried out within a range not changing the gist thereof.

The natural gas liquefaction device and the natural gas liquefaction method according to the present invention are suitable as a device and a method for supplying LNG by liquefying natural gas, particularly as a small-scale liquefaction device having only one expansion turbine.

Natural Gas Liquefaction Device

The configuration of the natural gas liquefaction device 10 of the present embodiment will be described in detail below.

As shown in FIG. 1, the natural gas liquefaction device 10 of the present embodiment is a device for producing liquefied natural gas (LNG) F by cooling and liquefying natural gas G. Specifically, the natural gas liquefaction device 10 mainly includes: a compressor 2 which is configured to compress a refrigerant mainly containing noncombustible gas, which is supplied from a refrigerant source 1 which is a convenience starting point for explaining the circulating refrigerant, in a plurality of compression stages 2A to 2D; a heat exchanger 4 which is configured to cool and liquefy a natural gas G to be a liquefied natural gas (LNG) F; a liquefaction line FL which is configured to introduce the natural gas G into the heat exchanger 4 and supply the liquefied natural gas F liquefied in the heat exchanger 4 to the outside; a first refrigerant line L1 which is configured to introduce a refrigerant-1 compressed by the compressor 2 into the heat exchanger 4, and further introduce the refrigerant-1 passed through the heat exchanger 4 into a decompressor 5; a second refrigerant line L2 which is configured to introduce the refrigerant-2 decompressed by the decompressor 5 into the heat exchanger 4, and introduce the refrigerant-2 passed through the heat exchanger 4 into any one of a second compression stage 2B and subsequent stages of the plurality of compression stages 2A to 2D provided in the compressor 2; a third refrigerant line L3 which is configured to be branched from the first refrigerant line L1 and introduce at least a part of the refrigerant-1 into an expansion turbine 3; and a fourth refrigerant line L4 which is configured to introduce the refrigerant-3 expanded by the expansion turbine 3 into the heat exchanger 4, and introduce the refrigerant-3 passed through the heat exchanger 4 into a first compression stage 2A of the plurality of compression stages 2A to 2D provided in the compressor 2.

In the natural gas liquefaction device 10 of the present embodiment, as shown in FIG. 1, the flow of the natural gas G and the flow of the refrigerant-1 to the refrigerant-3 are divided into a natural gas supply step and a refrigerant supply step as a whole.

In addition, the natural gas liquefaction device 10 as shown in FIG. 1 includes a braking blower 31 which is provided in the path of the first refrigerant line L1 and which is configured to compresses the refrigerant-1 flowing through the first refrigerant line L1, and a cooler 32 which is provided on the outlet side of the braking blower 31, in addition to the components above.

Moreover, the natural gas liquefaction device 10 as shown in FIG. 1 further includes a precooler 7 which is configured to cool the natural gas G and which is provided on the inlet side of the heat exchanger 4 in the liquefaction line FL.

The compressor 2 compresses the refrigerant supplied from the refrigerant source 1 in the plurality of compression stages 2A to 2D. In the compressor 2 shown in FIG. 1, the compression stages 2A to 2D are sequentially connected in series. Coolers 21B to 21D are provided on the outlet side of the respective compression stages 2B to 2D in the first refrigerant line L1. A cooler 21A is provided on the outlet side of the compression stage 2A in the fourth refrigerant line L4. In the embodiment shown in FIG. 1, the refrigerant source 1 is provided in the path of a fourth refrigerant line L4, the details of which will be described later, and noncombustible gas is supplied as a refrigerant from the fourth refrigerant line L4 into the compressor 2.

The compressor 2 is not particularly limited, and a compressor having a plurality of compression stages conventionally used in this technical field can be used without any limitation. In particular, a geared-type centrifugal compressor (Integrally geared) can be preferably used from the viewpoint that the design for introducing an additional fluid into any one of a second compression stage 2B and the subsequent stages is easy. On the other hand, a uniaxial-type centrifugal compressor (single shaft) is generally more expensive and less efficient than the geared-type compressor. Further, since the reciprocating-type compressor has a short maintenance cycle, in order to obtain the same LNG production amount as that of the geared-type compressor, it is necessary to compensate for the shortened operating time by increasing the size of the device, which increases the cost of the device. Therefore, from the viewpoint of the general operating conditions in actual use, it is preferable to employ the geared-type centrifugal compressor described above for the compressor 2.

Further, as the noncombustible gas used as the refrigerant supplied from the refrigerant source 1 toward the compressor 2, for example, nitrogen can be exemplified.

The expansion turbine 3 expands the refrigerant-1 compressed by the compressor 2. At least a part of the refrigerant-1 is introduced into the expansion turbine 3 by the third refrigerant line L3 branched at the branch point P in the first refrigerant line L1 described later in detail. Then, the refrigerant-1 expanded by the expansion turbine 3 is introduced into the heat exchanger 4 by the fourth refrigerant line L4 which will be described in detail later.

The braking blower 31 is provided on the first refrigerant line L1. As described above, the braking blower 31 is driven by the power generated by the expansion turbine 3, and further compresses the refrigerant-1 flowing through the first refrigerant line L1. The cooler 32 is provided on the outlet side of the braking blower 31 on the path of the first refrigerant line L1.

Also, the brake blower 31 can be omitted depending on the preset pressure of the refrigerant-1.

The liquefaction line FL, which will be described in detail later, and the first to fourth refrigerant lines L1 to L4 are inserted in the heat exchanger 4. With such a configuration, the heat exchanger 4 exchanges heat between the refrigerant-2 and the refrigerant-3 which have low temperature and the natural gas G, and cools and liquefies the natural gas G. Further, the heat exchanger 4 of the present embodiment is also capable of exchanging heat between the refrigerants. The refrigerant-2 flowing through the second refrigerant line L2 and the refrigerant-3 flowing through the fourth refrigerant line L4 cool the refrigerant-1 flowing through the first refrigerant line L1. The details thereof will be described later.

In the natural gas liquefaction device 10 of the present embodiment, an aluminum plate fin-type heat exchanger can be adopted as the heat exchanger 4. Aluminum plate fin-type heat exchangers, especially the serrated fin-type and herringbone fin-type aluminum plate fin-type heat exchangers, have characteristics which have extremely high heat exchange efficiency, although they do not have high withstand pressure. Since the natural gas liquefaction device 10 of the present embodiment operates the refrigerant supply step at a relatively low pressure, it is possible to improve the performance of the heat exchanger 4 and the entire device and reduce the size thereof by adopting the aluminum plate fin-type heat exchanger as the heat exchanger 4.

However, when the aluminum plate fin-type heat exchanger is adopted as the heat exchanger 4, there is a case in which the conventional technology cannot handle the pressure of 11.1 MPa, which is the minimum power consumption, depending on the regulations applied to the design of the heat exchanger. Even in the case in which the heat exchanger can handle the pressure, and the fin-type used has high strength, there is a problem in that since the structure is simple and the heat transfer performance is low, a large heat transfer area is required, and the device becomes large. In addition, there is a problem in that the design pressure is high and the cost is high. Furthermore, although shell & coil type (Shell & Coil) and diffusion bonding type (Diffusion bonding) heat exchangers can handle high pressures, the cost for the same performance is several times that of the aluminum plate fin-type heat exchanger.

When considering the problems in each type of heat exchanger in a comprehensive manner, as the heat exchanger 4, it is preferable to use an aluminum plate fin-type heat exchanger having a low design pressure and excellent heat transfer performance, such as a serrated fin-type.

The decompressor 5 decompresses and expands the refrigerant-1 introduced from the first refrigerant line L1 to make the refrigerant-2, at least a part of which is in the liquid phase. The outlet of the decompressor 5 is connected to one end of the second refrigerant line L2, and the second refrigerant line L2 introduces the refrigerant-2 into the heat exchanger 4.

The decompressor 5 is not particularly limited as long as it can decompress the refrigerant, but specifically, a decompression valve such as a JT valve can be used. In addition, a liquid turbine can be used as the decompressor 5.

The natural gas liquefaction device 10 of the present embodiment includes the first refrigerant line L1, the second refrigerant line L2, the third refrigerant line L3, and the fourth refrigerant line L4 which form a refrigerant supply step (refrigerant path B), and the liquefaction line FL which forms a natural gas supply step. Each line used in the natural gas supply step and the refrigerant supply step is made of, for example, an appropriate pipe through which the respective fluid can flow.

As described above, the liquefaction line FL introduces the natural gas G into the heat exchanger 4 and supplies the liquefied natural gas F cooled and liquefied by the heat exchanger 4 to the outside.

That is, the liquefaction line FL shown in FIG. 1 has an inlet side which is connected to the natural gas source 6, and an outlet side which is connected to the storage tank for storing the liquified natural gas F, and is inserted from the precooler 7 toward the heat exchanger 4 provided in the path.

As described above, the first refrigerant line L1 introduces the refrigerant-1 compressed by the compressor 2 into the heat exchanger 4, and further introduces the refrigerant-1 passed through the heat exchanger 4 into the decompressor 5.

That is, the first refrigerant line L1 shown in FIG. 1 has an inlet side which is connected to the compression stage 2D which is the final stage of the compressor 2 through the cooler 21D. Then, the first refrigerant line L1 is inserted in the heat exchanger 4 through the braking blower 31 and the cooler 32. The outlet side of the first refrigerant line L1 passed through the heat exchanger 4 is connected to the inlet of the decompressor 5.

As shown in FIG. 1, the second refrigerant line L2 introduces the refrigerant-2 decompressed by the decompressor 5 into the heat exchanger 4 and introduces the refrigerant-2 passed through the heat exchanger 4 into any one of a compression stage 2B which is the second stage and the subsequent stages of the plurality of compression stages 2A to 2D in the compressor 2.

That is, one end side of the second refrigerant line L2 shown in FIG. 1 is connected to the outlet of the decompressor 5. The second refrigerant line L2 passes through the heat exchanger 4. The other end of the second refrigerant line L2 is connected to the inlet of the second compression stage 2B in the compressor 2.

As shown in FIG. 1, the third refrigerant line L3 is branched at a branch point P of the first refrigerant line L1 and introduces at least a part of the refrigerant-1 into the expansion turbine 3.

That is, one end side of the third refrigerant line L3 shown in FIG. 1 is connected to the first refrigerant line L1 inserted in the heat exchanger 4, and the other end is connected to the inlet of the expansion turbine 3.

As shown in FIG. 1, the fourth refrigerant line L4 introduces the refrigerant-3 expanded by the expansion turbine 3 into the heat exchanger 4, and introduces the refrigerant-3 passed through the heat exchanger 4 into the first compression stage 2A of the plurality of compression stages 2A to 2D provided in compressor 2.

That is, one end side of the fourth refrigerant line L4 shown in FIG. 1 is connected to the outlet side of the expansion turbine 3. The fourth refrigerant line L4 is inserted in the heat exchanger 4. The other end side is connected to the outlet side of the second compression stage 2A in the compressor 2.

It is preferable that the natural gas liquefaction device 10 of the present embodiment be provided with a precooler 7 which cools the natural gas G with a vaporization type refrigerant before introducing the natural gas G into the heat exchanger 4 through the liquefaction line FL. In the embodiment shown in FIG. 1, the precooler 7 is provided on the inlet side of the heat exchanger 4 in the liquefaction line FL. As described above, the liquefied gas G can be introduced into the heat exchanger 4 in a state of being cooled to a predetermined temperature or lower in advance by providing the precooler 7. Therefore, the effect of improving the liquefaction efficiency of the natural gas G in the heat exchanger 4 can be obtained.

The precooler 7 is not particularly limited, but it is possible to employ, for example, a freon refrigerator.

According to the natural gas liquefaction device 10 of the present embodiment, the power consumption can be reduced particularly in the range in which the pressure at the inlet of the expansion turbine is relatively low by providing the configuration above, although the details will be described later. As a result, as the heat exchanger, it is possible to use a low-pressure type heat exchanger with high heat transfer performance, specifically, an aluminum plate fin-type heat exchanger. Therefore, the performance of the heat exchanger can be improved and the size can be reduced, and therefore, the size of the entire device can also be reduced.

Natural Gas Liquefaction Method

The natural gas liquefaction method of the present embodiment will be described below with reference to FIG. 1.

In the present embodiment, a method for liquefying natural gas using the natural gas liquefaction device 10 of the present embodiment as described above will be described.

The natural gas liquefaction method of the present embodiment is a method for producing liquefied natural gas (LNG) F by cooling and liquefying the natural gas G. Specifically, the natural gas liquefaction method of the present embodiment includes a natural gas supply step of introducing the natural gas G into the heat exchanger 4 and supplying liquefied natural gas (LNG) F liquefied by being cooled by the heat exchanger 4 to the outside, and a refrigerant supply step of introducing a refrigerant mainly containing noncombustible gas into the heat exchanger 4 in order to cool the natural gas G introduced into the heat exchanger 4.

The refrigerant supply step includes: a refrigerant supply step a of introducing the refrigerant-1 obtained by compressing a noncombustible gas by the compressor 2 having the plurality of compression stages 2A to 2D into the heat exchanger 4, and introducing the refrigerant-1 passed through the heat exchanger 4 into the decompressor 5; a refrigerant supply step b of introducing the refrigerant-2 reduced in temperature by decompression/expansion by the decompressor 5 and at least a part of which is in the liquid phase, into the heat exchanger 4, and introducing the refrigerant-2 passed through the heat exchanger 4 and heated into any one of a second compression stage 2B and subsequent stages of the plurality of compression stages 2A to 2D provided in the compressor 2; a refrigerant introducing step c of introducing at least a part of the refrigerant-1 in the refrigerant supply step a into the expansion turbine 3; and a refrigerant supplying step d of introducing the refrigerant-3 expanded and reduced in pressure and temperature by the expansion turbine 3 into the heat exchanger 4, and introducing the refrigerant-3 passed through the heat exchanger 4 and heated into the first compression stage 2A of the plurality of compression stages 2A to 2D provided in the compressor 2.

That is, in the natural gas liquefaction method of the present embodiment, the refrigerant supply step a corresponds to the first refrigerant line L1 of the natural gas liquefaction device 10. The refrigerant supply step b corresponds to the second refrigerant line L2. The refrigerant supply step c corresponds to the third refrigerant line L3. The refrigerant supply step d corresponds to the fourth refrigerant line L4.

In the natural gas liquefaction method of the present embodiment, the natural gas in the natural gas supply step and at least a part of the refrigerant in the refrigerant supply steps a to d constituting the refrigerant supply step pass through the heat exchanger 4. As a result, the refrigerant-2 and the refrigerant-3 cool the refrigerant-1 in the heat exchanger 4. Further, the refrigerant-2 and refrigerant-3 cool the natural gas G in the heat exchanger 4.

The procedure of the natural gas liquefaction method of the present embodiment is explained in detail below.

First, in the refrigerant supply step a, nitrogen, which is a noncombustible gas, is supplied from the refrigerant source 1 into the compressor 2. Then, in the compressor 2 having a plurality of compression stages 2A to 2D, nitrogen is compressed in multiple stages. As a result, the refrigerant-1 obtained is introduced into the heat exchanger 4 from the outlet side of the compression stage 2D, which is the final stage, through the first refrigerant line L1. Then, the refrigerant-1 passed through the heat exchanger 4 is introduced into the decompressor 5 through the first refrigerant line L1.

In the refrigerant supply step b, the refrigerant-2 reduced in temperature by decompression/expansion by the decompressor 5 and at least a part of which is in the liquid phase, is introduced into the heat exchanger 4 through the second refrigerant line L2. Then, the refrigerant-2 passed through the heat exchanger 4 and heated is introduced into any one of a compression stage 2B which is the second stage and the subsequent stages of the plurality of compression stages 2A to 2D, provided in the compressor 2. In the embodiment shown in FIG. 1, the refrigerant-2 is introduced into the inlet of the compression stage 2B.

In the refrigerant supply step c, at least a part of the refrigerant-1 is introduced into the expansion turbine 3 through the third refrigerant line L3 branched at the branch point P of the first refrigerant line L1 through which the refrigerant-1 flows in the refrigerant supply step a.

In the refrigerant supply step d, the refrigerant-3 expanded in the expansion turbine 3, and reduced in pressure and temperature is introduced into the heat exchanger 4 through the fourth refrigerant line L4. Then, the refrigerant-3 passed through the heat exchanger 4 and heated is introduced into the first compression stage 2A of the plurality of compression stages 2A to 2D provided in the compressor 2.

Further, in the natural gas supply step of the present embodiment, the natural gas G supplied from the natural gas source 6 is introduced into the heat exchanger 4 through the natural gas line FL at substantially the same time as the refrigerant supply steps a to d, and is cooled and liquefied.

Then, the liquefied natural gas (LNG) F which is liquefied in the heat exchanger 4 is introduced into the storage tank 8 through the liquefaction line FL.

In the natural gas liquefaction method of the present embodiment, by carrying out each of the refrigerant supply step a to refrigerant supply step d in the refrigerant supply step, the effects as described below can be obtained.

First, in the refrigerant supply step c, at least a part of the refriegerant-1 flowing through the first refrigerant line L1 is taken out by the third refrigerant line L3 at a substantially intermediate temperature, and then expanded by the expansion turbine 3, whereby the low temperature refrigerant-3 is obtained. Then, in the heat exchange in the heat exchanger 4, the refrigerant-3 and the natural gas G are mainly heat exchanged, and the cooled natural gas G is liquefied to obtain the liquefied natural gas F.

The refrigerant-3 heated to a temperature close to room temperature by heat exchange with the natural gas G is returned to the inlet of the first compression stage 2A of the compressor 2 and compressed again.

Further, in the heat exchanger 4, the residual refrigerant-1 after at least a part of which has been taken out by the third refrigerant line L3 is cooled to a temperature lower than the intermediate temperature by exchanging heat with the refrigerant-2 and the refrigerant-3. Then, by expanding the refrigerant-1 having a temperature lower than the intermediate temperature by the decompressor 5, the refrigerant-2, at least a part of which is liquefied and which has a higher pressure and a lower temperature than those of the refrigerant-3 expanded by the expansion turbine 3 and reduced in pressure and temperature, is obtained.

Further, in the heat exchanger 4, heat exchange is performed between the refrigerants-2 and 3 and the natural gas G to cool the natural gas G, and heat exchange is performed between the refrigerants-2 and 3 the refrigerant-1 compressed by the compressor 2 to cool the refrigerant-1. Then, the refrigerant-2 vaporized by these heat exchanges and reached approximately room temperature, is returned to the inlet of the second compression stage 2B or later in the compressor 2.

In the present embodiment, the pressure of the refrigerant-3 returned from the expansion turbine 3 to the heat exchanger 4 through the fourth refrigerant line L4 is greatly reduced by the expansion turbine 3 and is lower than the pressure of the refrigerant-2 decompressed by the decompressor 5. Therefore, in the present embodiment, after the refrigerant-3 is used to cool the natural gas G and the refrigerant-1 in the heat exchanger 4, the refrigerant-3 is returned to the first compression stage 2A of the compressor 2 and sufficiently compressed by the plurality of compression stages 2A-2D.

On the other hand, the pressure of refrigerant-2, which is decompressed by the decompressor 5 and returned into the inside of the heat exchanger 4, is higher than that of the refrigerant-3. Therefore, after being used to cool the natural gas G and the refrigerant-1 by heat exchange, the refrigerant-2 is introduced into any one of the compression stage 2B and the subsequent stages (compression stage 2B in the embodiment shown in FIG. 1) in a state of approximately normal temperature.

Therefore, compared with the conventional case (see also FIG. 3), in which all of the refrigerants passed through the heat exchanger in the refrigerant system are introduced into the first compression stage of the compressor, the natural gas liquefaction method of the present embodiment can reduce the power consumption of the compressor, that is, the power consumption of the entire device can be reduced.

That is, as will be described in detail in Examples below, in the natural gas liquefaction method of the present embodiment, for example, it is possible to reduce the pressure at the outlet ((vi) in FIG. 1) of the expansion turbine 3 while maintaining the pressure at the outlet ((viii) in FIG. 1) of the decompressor 5 equipped with the JT valve at 1.3 MPa. As a result, when the pressure at the outlet (the same (iii)) of the compressor 2 is reduced, the problem of the expansion ratio of the expansion turbine 3 becoming small and the flow rate increasing can be resolved. Further, it is not necessary to use unnecessary power to unnecessarily compress the low-pressure refrigerant-2 decompressed by the decompressor 5 and passed through the heat exchanger 4. As a result, for example, even when the pressure at the outlet of the compressor 2 is designed to be lower than the pressure at which the power consumption is minimized for practical reasons, it is possible to significantly improve the power consumption compared to the conventional method.

On the other hand, in the conventional technique (see also FIG. 3), when the pressure at the outlet of the expansion turbine 103 is lowered, the pressure at the outlet of the decompressor 102 is also lowered at the same time, so the loss increases as the pressure is lowered.

That is, as will be described in Examples described later, if the high pressure device is designed by focusing only on the improvement of the cooling performance, there is no great difference in the cooling performance between the present embodiment and the prior art. However, in the case of designing at a low pressure focusing on a more realistic actual use environment, the natural gas liquefaction device of the present embodiment is smaller and cheaper, and also has excellent cooling performance.

In the natural gas liquefaction method of the present embodiment, it is preferable that the pressure on the inlet side of the expansion turbine 3 in the refrigerant supply step c shown in (v) of FIG. 1 be less than 9 MPa. Further, from the viewpoint of reducing power consumption in the range of relatively low refrigerant pressure, the pressure on inlet side of the expansion turbine 3 is preferably 6 to 8 MPa, and more preferably 7 to 7.5 MPa.

In the natural gas liquefaction method of the present embodiment, it is more preferable to further compress the refrigerant-1 compressed in multiple stages by the compressor 2 in the refrigerant supply step a. In the embodiment shown in FIG. 1, the braking blower 31 additionally compresses the refrigerant-1 and then the refrigerant-1 is introduced into the heat exchanger 4. As described above, by further compressing the refrigerant-1 by using the power generated in the expansion turbine 3, the refrigerant can be introduced into the heat exchanger 4 at a higher pressure without increasing the power consumption of the compressor 2.

Further, in the natural gas supply step of the present embodiment, it is more preferable that the natural gas G before being introduced into the heat exchanger 4 be precooled by a vaporization type refrigerant. In the embodiment shown in FIG. 1, the natural gas G is precooled by the precooler 7, such as the freon refrigerator, and then introduced into the heat exchanger 4. By pre-cooling the natural gas G in this manner, as described above, the liquefied gas G can be introduced into the heat exchanger 4 in a state of being cooled to a predetermined temperature or less in advance, so that the liquefaction efficiency of the natural gas G in the heat exchanger 4 is improved.

Effect

As explained above, the natural gas liquefaction device 10 of the present embodiment includes the second refrigerant line L2 which is configured to introduce the refrigerant-2 decompressed by the decompressor 5 and passed through the heat exchanger 4 into any one of the second compression stage 2B and the subsequent stages of the plurality of compression stages 2A to 2D, and the fourth refrigerant line L4 which is configured to introduce the refrigerant-3 expanded in the expansion turbine 3 and passed through the heat exchanger 4 into the first compression stage 2A of the compressor 2. That is, the refrigerant-3 returned from the heat exchanger 4 at a relatively low pressure is introduced into the first compression stage 2A of the plurality of compression stages 2A-2D. On the other hand, the refrigerant-2 returned from the heat exchanger 4 at a relatively high pressure is introduced into any one of the second compression stage 2B and the subsequent stages of the plurality of compression stages 2A to 2D. Therefore, it becomes possible to reduce the power consumption particularly in a range in which the pressure at the inlet of the expansion turbine is relatively low. As a result, the aluminum plate fin-type heat exchanger and the like which has a high heat transfer performance and a low pressure specification can be used as the heat exchanger 4, so that the performance and the size of the heat exchanger 4 can be improved, and the size and cost of the entire device can also be reduced.

Further, as will be described in detail in Examples ([Evaluation result], Example 2 (Table 3)), when the flow rate of the entire refrigerant is 100%, that is, when the flow rate of the refrigerant flowing through the compression stage 2B is 100%, the flow rate of the refrigerant-2 in the second refrigerant line L2 is as small as less than 10%. Therefore, the flow rate of the refrigerant-3 from the fourth refrigerant line L4 into the compression stage 2A is about 90% when the flow rate of the entire refrigerant is 100%. In this way, the flow rate difference between the compressors 2A to 2D becomes small, and it becomes easy to design these compression stages 2A to 2D as an integral compressor 2.

Furthermore, when a pressure-reducing valve is used as the decompressor 5, it can be applied to a small-scale device with a small flow rate of the second refrigerant line L2.

Further, in the natural gas liquefaction method of the present invention, the refrigerant supply step includes the refrigerant supply step b of introducing the refrigerant-2 reduced in temperature by decompression/expansion by the decompressor 5 and at least a part of which is in the liquid phase, into the heat exchanger 4, and introducing the refrigerant-2 passed through the heat exchanger 4 and heated into any one of the second compression stage 2B and the subsequent stages of the plurality of compression stages 2A to 2D provided in the compressor 2, and the refrigerant supplying step d of introducing the refrigerant-3 expanded and reduced in pressure and temperature by the expansion turbine 3 into the heat exchanger 4, and introducing the refrigerant-3 passed through the heat exchanger 4 and heated, into the first compression stage 2A of the plurality of compression stages 2A to 2D provided in the compressor 2. As a result, similarly to the above, the refrigerant-3 returned from the heat exchanger 4 at a relatively low pressure is introduced into the first compression stage 2A. On the other hand, since the refrigerant-2 returned from the heat exchanger 4 at a relatively high pressure is introduced into any one of the second compression stage 2B and the subsequent stages, the power consumption can be reduced in the range in which the pressure at the inlet of the expansion turbine 3 is relatively low. As a result, the size of the device used can be reduced, and the operating cost can be reduced.

Other Embodiments

The natural gas liquefaction device and the natural gas liquefaction method according to the present invention are not limited to the above embodiments, and various modifications can be made without departing from the spirit of the present invention.

For example, the compressor 2 in the embodiment shown in FIG. 1 includes a total of four compression stages 2A to 2D. However, the number of compression stages is not limited to this embodiment, and may be, for example, a total of two stages or a total of five or more stages in consideration of the cooling performance of the natural gas liquefaction device.

Further, the position at which the refrigerant-2 is introduced in the compressor 2 is not limited to the inlet of the second compression stage 2B in the embodiment shown in FIG. 1. While considering the pressure of the refrigerant-2, for example, the refrigerant-2 may be introduced into the inlet of the third compression stage 3C.

Further, in the embodiment shown in FIG. 1, the braking blower 31 and the cooler 32 are provided in the first refrigerant line L1. However, these can be omitted if the compression of the refrigerant-1 in the compressor 2 is sufficient.

Further, in the present embodiment, the liquefied natural gas (LNG) F liquefied in the heat exchanger 4 is introduced into the storage tank 8 through the liquefaction line FL and stored therein. However, the present invention is not limited to this embodiment. For example, it is possible to employ a configuration in which the liquefied natural gas (LNG) F is directly supplied to a plant or the like outside the device through the liquefaction line FL.

Figure 4:
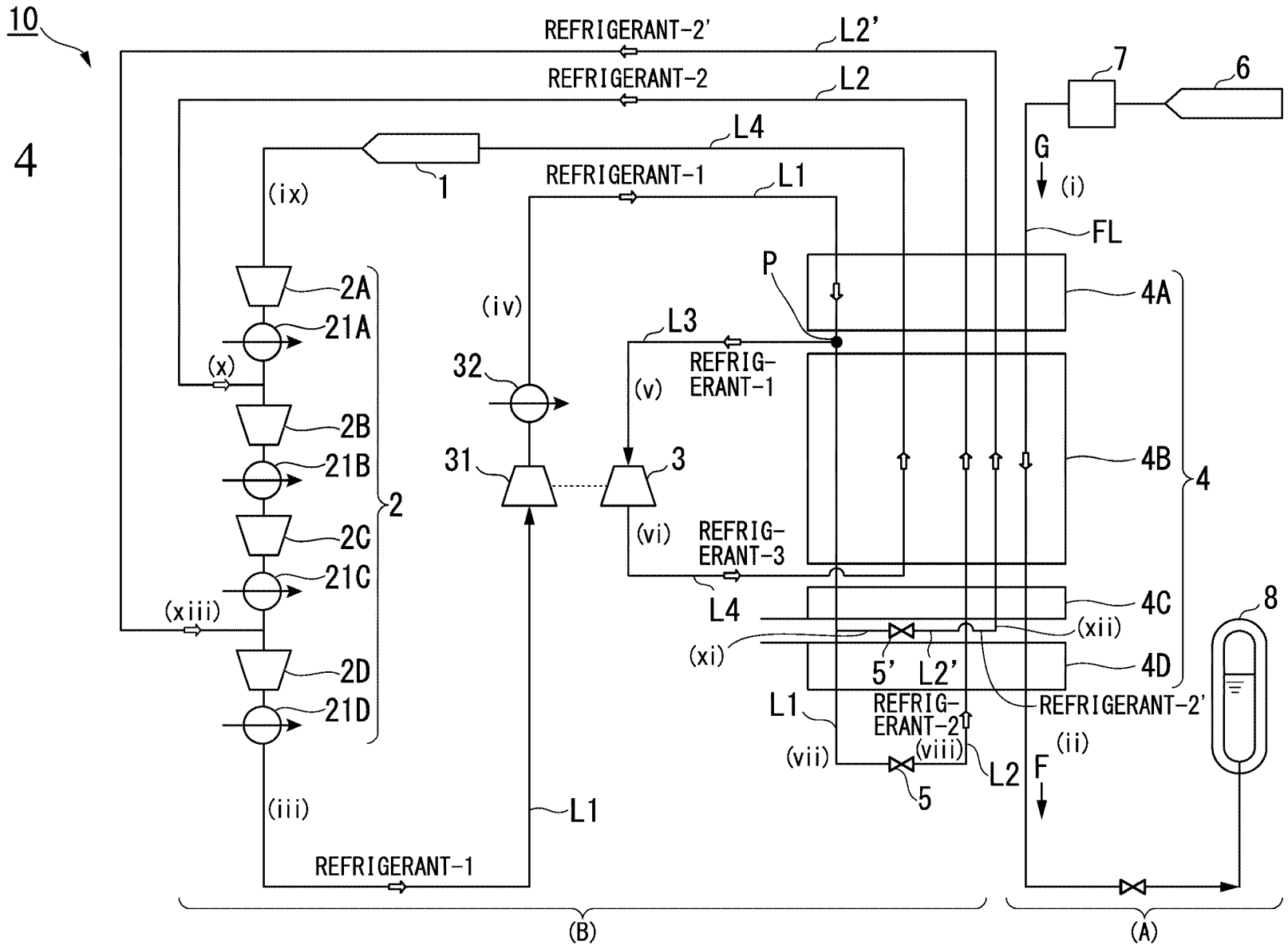
FIG. 4 is a diagram schematically showing a natural gas liquefaction device and a natural gas liquefaction method according to another embodiment of the present invention, and is a system diagram showing a configuration of the entire device.

Furthermore, according to another embodiment shown in FIG. 4, it is possible to obtain further effects with a small additional cost. A natural gas liquefaction device and a natural gas liquefaction method, which are other embodiments according to the present invention, will be explained below with reference to FIGS. 1 and 4 as appropriate.

In the natural gas liquefaction device and natural gas liquefaction method shown in FIG. 1, the heat exchanger 4 is an integral type, whereas in the natural gas liquefaction device and natural gas liquefaction method shown in FIG. 4, the heat exchanger is divided into heat exchangers 4A to 4D. The division increases the number of heat exchangers and requires connecting pipes, which increases costs. However, the heat exchangers 4C and 4D having a temperature lower than the temperature of the heat exchanger 4B for introducing the refrigerant-3 expanded by the expansion turbine 3 have a smaller number of fluid flows than the heat exchangers 4A and 4B having a higher temperature. The temperature is low throughout and the fluid density is high. Therefore, the cross-sectional area of the flow path can be reduced. By dividing the heat exchanger, the total volume of the heat exchangers can be made smaller than that of the integrated type heat exchanger.

Further, the refrigerant-2 introduced from the decompressor 5 into the heat exchanger 4D and the refrigerant-2' introduced into the heat exchanger 4C from the decompressor 5' can be a gas-liquid two-phase flow. Therefore, in order to prevent deterioration of the performance of the heat exchangers, it is important to make the gas-liquid distribution in the flow path uniform. To avoid this problem, an effective countermeasure is to divide the heat exchanger at the position at which the refrigerant-3 expanded by the expansion turbine 3 is introduced, as a boundary, and reduce the cross-sectional area of the flow paths of the heat exchangers 4C and 4D which are at lower temperatures.

Further, for example, by dividing the heat exchangers 4A and 4B and arranging the heat exchangers side by side in the horizontal direction with respect to the flow direction of the refrigerant, it becomes easy to suppress the height of the cold insulation box for storing them, to divide into a plurality of small cold storage boxes. As a result, the device can be made into a unit that requires a shorter installation time and can be easily relocated.

Furthermore, it is also possible to install the decompressor 5 and the decompressor 5', and introduce the refrigerant-2 and the refrigerant-2', which have different pressures, into different compression stages which are any one of the second compression stage 2B and the subsequent stages of the plurality of compression stages 2A to 2D provided in the compressor 2 through the second refrigerant line L2 and the second refrigerant line L2'. As will be described in detail in Examples below, at this time, the pressure of the refrigerant-2 flowing through the second refrigerant line L2 is 1.3 MPa in order to cool the natural gas to −160° C. as in the embodiment shown in FIG. 1. On the other hand, the boiling point of the refrigerant-2' flowing through the second refrigerant line L2' for cooling the higher temperature region may be higher than that of the refrigerant-2, so that the pressure can be higher than 1.3 MPa.

Therefore, according to the natural gas liquefaction device and the natural gas liquefaction method of another embodiment shown in FIG. 4, since a part of the refrigerant can be returned into the compression stage at a pressure higher than 1.3 MPa, it is possible to further reduce the power consumption as compared with the embodiment of FIG. 1 in which all of the refrigerant is returned at 1.3 MPa.

In addition, the division of the heat exchanger and the plurality of the second refrigerant lines L2 can be individually adopted. Further, it is possible to further increase the number of divisions of the heat exchanger to further reduce the size of each unit. It is also possible to increase the number of the second refrigerant line L2 to three to further reduce the power consumption.

EXAMPLES

Hereinafter, the natural gas liquefaction device and the natural gas liquefaction method of the present invention will be described in more detail by Examples. However, the present invention is not limited to the following Examples, and can be implemented with appropriate modifications within the scope of the invention.

Reference Example

Figure 3:
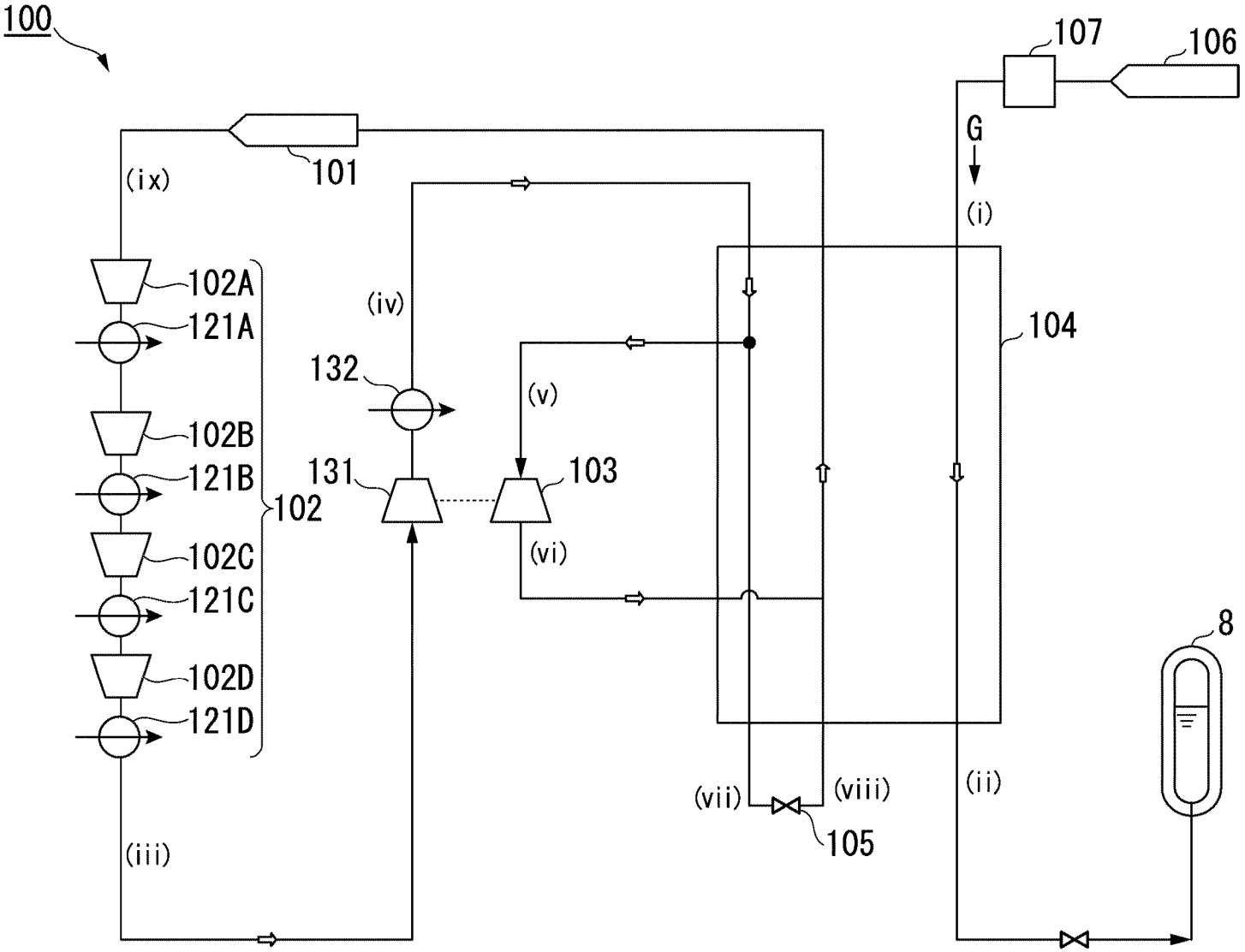
FIG. 3 is a system diagram showing a configuration of a conventional natural gas liquefaction device.

First, as a Reference Example, LNG was produced by cooling and liquefying natural gas using the conventional natural gas liquefaction device 100 shown in FIG. 3. In the natural gas liquefaction device 100 of the Reference Example, a JT valve was used as the decompressor 105. As the compressor 102, a compressor having a total of four compression stages 102A to 102D and provided with coolers 121A to 121D on the outlet side of respective compression stage 102A to 102D was used. Further, nitrogen gas was used as the refrigerant.

The pressure at the outlet of the expansion turbine 103 was 1.3 MPa. As is clear from the structure of the natural gas liquefaction device 100, the pressure at the outlet of the decompressor 105 was also 1.3 MPa.

Further, by changing the pressure at the inlet of the expansion turbine 103, which is the condition for liquefying the natural gas, the flow rate, the pressure, and the temperature of the fluid flowing through the respective positions (i) to (x) in FIG. 3 and the power consumption (kw) were measured. Specifically, the conditions in which the pressure at the inlet of the expansion turbine 103 was 11.1 MPa are shown in Table 1 below, and the conditions in which the pressure at the inlet of the expansion turbine 103 was 7.2 MPa are shown in Table 2 below.

Examples 1 and 2

In Examples 1 and 2, the natural gas liquefaction device 10 shown in FIG. 1 was used to cool and liquefy natural gas to produce LNG. In the natural gas liquefaction device 10 used in these Examples, a JT valve was used as the decompressor 5. As the compressor 2, a compressor having a total of four compression stages 2A to 2D and provided with coolers 21A to 21D on the outlet sides of the respective compression stages 2A to 2D was used. Also in these Examples, nitrogen gas was used as the refrigerant.

In Example 1, the pressure at the outlet of the decompressor 5 was 1.3 MPa, which was the same as in the Reference Example, and the pressure at the outlet of the expansion turbine 3 was 0.9 MPa.

Figure 2:
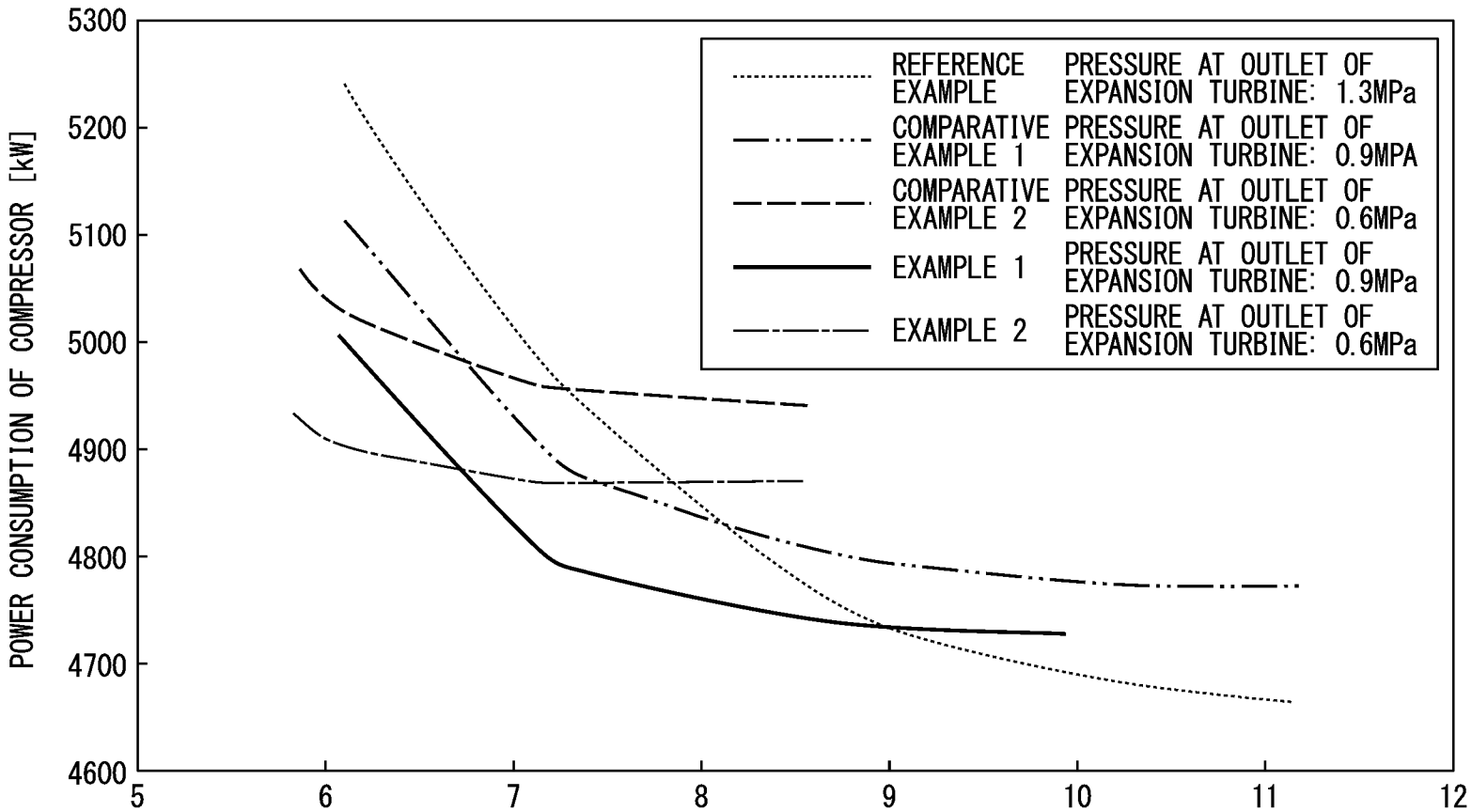
FIG. 2 is a diagram explaining an embodiment of a natural gas liquefaction device and a natural gas liquefaction method of the present invention, and is a graph showing the relationship between a pressure on the inlet side of an expansion turbine and a power consumption of a compressor.

A graph showing the relationship between the pressure at the inlet of the expansion turbine 103 and the power consumption of the compressor 2 when liquefying natural gas under such conditions is shown in FIG. 2, Example 1.

In Example 2, the pressure at the outlet of the decompressor 5 was 1.3 MPa, which was the same as in the Reference Example, the pressure at the outlet of the expansion turbine 3 was 0.6 MPa, and the pressure at the inlet of the expansion turbine 3 was 7.2 MPa (the same pressure as in the Reference Example). Similarly to the Reference Example above, the flow rate, the pressure, and the temperature of the fluid flowing through the respective positions (i) to (x) and the power consumption (kw) of the compressor 2 were measured. The results are shown in Table 3 below.

Comparative Examples 1 and 2

In Comparative Examples 1 and 2, the conventional natural gas liquefaction device 100 shown in FIG. 3 was used to cool and liquefy natural gas to produce LNG in the same manner as in the Examples.

In the natural gas liquefaction device 100 used in Comparative Examples 1 and 2, a JT valve was used as the decompressor 105. As the compressor 102, a compressor having a total of four compression stages 102A to 102D and provided with coolers 121A to 121D on the outlet side of respective compression stage 102A to 102D was used. Also in Comparative Examples 1 and 2, nitrogen gas was used as the refrigerant.

In Comparative Example 1, the pressure at the outlet of the expansion turbine 103 was 0.9 MPa, and the pressure was 0.6 MPa in Comparative Example 2.

Also, similar to the Reference Example, due to the configuration of the natural gas liquefaction device 100, the pressure at the outlet of the decompressor 105 was the same as the pressure at the outlet of the expansion turbine 103 in Comparative Examples 1 and 2.

A graph showing the relationship between the pressure at the inlet of the expansion turbine 103 and the power consumption of the compressor 102 when liquefying natural gas under such conditions is shown in FIG. 2, Comparative Example 1 and Comparative Example 2.

In Comparative Example 2, the pressure at the inlet of the expansion turbine 103 was 7.2 MPa (the same pressure as in Reference Example and Example 2). The flow rate, the pressure, and the temperature of the fluid flowing through the respective position (i) to (x) in FIG. 3 and the power consumption (kw) of the compressor 2 were measured. The results are shown in Table 4 below.

Example 3

In Example 3, the natural gas liquefaction device 10 shown in FIG. 4, LNG was used to cool and liquefy natural gas under the following conditions and procedures to produce LNG.

In the natural gas liquefaction device 10 used in this Example, a decompressor 5' was provided in addition to the decompressor 5, and a JT valve was used as the decompressors 5 and 5'. Further, as the compressor 2, a compressor having a total of four compression stages 2A to 2D and provided with coolers 21A to 21D on the outlet sides of the respective compression stages 2A to 2D was used. Also in this example, nitrogen gas was used as the refrigerant.

In Example 3, the pressure at the outlet of the decompressor 5 was 1.3 MPa, and the pressure at the outlet of the decompressor 5' was 2.6 MPa. Further, the pressure at the inlet of the expansion turbine 3 was 7.2 MPa and the pressure at the outlet was 0.6 MPa.

That is, the pressures at the inlet and outlet of the decompressor 5 and the expansion turbine 3 were the same as those in Example 2. The flow rate, the pressure, and the temperature of the fluid flowing through the respective position (i) to (xiii) in Example 3 and the power consumption (kw) of the compressor 2 were measured. The results are shown in Table 5 below.

TABLE 1

| Reference Example (Pressure at inlet of expansion turbine: 11.1 MPa) | | | | | | | | | |
|---|---|---|---|---|---|---|---|---|---|
| Position | (i) | (ii) | (iii) | (iv) | (v) | (vi) | (vii) | (viii) | (ix) |
| Flow rate ($Nm^3/h$) | 10800 | 10800 | 62700 | 62700 | 56500 | 56500 | 6200 | 6200 | 62700 |
| Pressure (MPa (abs.)) | 3.1 | 3.1 | 6.1 | 11.1 | 11.1 | 1.3 | 11.1 | 1.3 | 1.3 |
| Temperature (° C.) | 40 | −163 | 40 | 40 | −29 | −134 | −163 | −165 | 38 |
| Power Consumption (kW) | | | | | 4660 | | | | |

TABLE 2

| Reference Example (Pressure at inlet of expansion turbine: 7.2 MPa) | | | | | | | | | |
|---|---|---|---|---|---|---|---|---|---|
| Position | (i) | (ii) | (iii) | (iv) | (v) | (vi) | (vii) | (viii) | (ix) |
| Flow rate ($Nm^3/h$) | 10800 | 10800 | 84100 | 84100 | 73200 | 73200 | 10900 | 10900 | 84100 |
| Pressure (MPa (abs.)) | 3.1 | 3.1 | 4.5 | 7.2 | 7.2 | 1.3 | 7.2 | 1.3 | 1.3 |
| Temperature (° C.) | 40 | −163 | 40 | 40 | −45 | −128 | −163 | −165 | 38 |
| Power Consumption (kW) | | | | | 4970 | | | | |

TABLE 3

| Example 2 (Pressure at inlet of expansion turbine: 7.2 MPa) | | | | | | | | | | |
|---|---|---|---|---|---|---|---|---|---|---|
| Position | (i) | (ii) | (iii) | (iv) | (v) | (vi) | (vii) | (viii) | (ix) | (x) |
| Flow rate ($Nm^3/h$) | 10800 | 10800 | 57900 | 57900 | 53500 | 53500 | 4400 | 4400 | 53500 | 4400 |
| Pressure (MPa (abs.)) | 3.1 | 3.1 | 3.6 | 7.2 | 7.2 | 0.6 | 7.2 | 1.3 | 0.6 | 1.3 |
| Temperature (° C.) | 40 | −163 | 40 | 40 | −30 | −143 | −163 | −165 | 38 | 38 |
| Power Consumption (kW) | | | | | 4870 | | | | | |

TABLE 4

| Comparative Example 2 (Pressure at inlet of expansion turbine: 7.2 MPa) | | | | | | | | | |
|---|---|---|---|---|---|---|---|---|---|
| Position | (i) | (ii) | (iii) | (iv) | (v) | (vi) | (vii) | (viii) | (ix) |
| Flow rate ($Nm^3/h$) | 10800 | 10800 | 57500 | 57500 | 53400 | 53400 | 4100 | 4100 | 57500 |
| Pressure (MPa (abs.)) | 3.1 | 3.1 | 3.6 | 7.2 | 7.2 | 0.6 | 7.2 | 0.6 | 0.6 |
| Temperature (° C.) | 40 | −163 | 40 | 40 | −30 | −143 | −163 | −176 | 38 |
| Power Consumption (kW) | | | | | 4960 | | | | |

TABLE 5

| Example 3 (Pressure at inlet of expansion turbine: 7.2 MPa) | | | | | | | | | | |
|---|---|---|---|---|---|---|---|---|---|---|
| Position | (i) | (ii) | (iii) | (iv) | (v) | (vi) | (vii) | (viii) | (ix) | (x) |
| Flow rate ($Nm^3/h$) | 10800 | 10800 | 58400 | 58400 | 53600 | 53600 | 2000 | 2000 | 53600 | 2000 |
| Pressure (MPa (abs.)) | 3.1 | 3.1 | 3.6 | 7.2 | 7.2 | 0.6 | 7.2 | 1.3 | 0.6 | 1.3 |
| Temperature (° C.) | 40 | −163 | 40 | 40 | −30 | −143 | −163 | −165 | 38 | 38 |
| Position | (xi) | (xii) | (xiii) | | | | | | | |
| Flow rate ($Nm^3/h$) | 2800 | 2800 | 2800 | | | | | | | |
| Pressure (MPa (abs.)) | 7.2 | 2.6 | 2.6 | | | | | | | |
| Temperature (° C.) | −151 | −154 | 38 | | | | | | | |
| Power Consumption (kW) | | | | | 4820 | | | | | |

Explanation of Tables 1 to 5

Table 1 shows the flow rate, the pressure, and the temperature of the fluid flowing through the respective positions and the power consumption (kw) of the compressor 102 in the natural gas liquefaction method of the Reference Example using the natural gas liquefaction device 100 having the conventional configuration.

Table 1 shows, in the natural gas liquefaction method of the Reference Example using the natural gas liquefaction device 100 having the conventional configuration, the conditions of an example in which the power consumption was minimized.

Table 2 shows, in the natural gas liquefaction method of the Reference Example using the conventional natural gas liquefaction device 100, the conditions of an example in which the pressure at the outlet ((vi) in FIG. 3) of the expansion turbine was the same as that of the Reference Example described in Table 1 and the pressure at the outlet ((vi) in FIG. 3) of the expansion turbine lowered.

Table 3 shows, in the natural gas liquefaction method of Example 2 using the natural gas liquefaction device 10 according to the present invention, the conditions of an example in which the pressure at the inlet ((v) in FIG. 1) of the expansion turbine was the same as that of the Reference Example described in Table 2.

Table 4 shows, in the natural gas liquefaction method of Comparative Example 2 using the natural gas liquefaction device 100, the conditions of an example in which the pressure at the inlet ((v) in FIG. 3) and the outlet ((vi) in FIG. 3) of the expansion turbine were the same as those of the Example 3 shown in Table 3.

Table 4 shows, in the natural gas liquefaction method of Example 3 using the natural gas liquefaction device 10 shown in FIG. 4 according to the other embodiment, the conditions of an example in which the pressure at the inlet ((v) in FIG. 4) and the outlet ((vi) in FIG. 4) of the expansion turbine 3, and the pressure at the inlet ((vii) in FIG. 4) and the outlet ((viii) in FIG. 4) of the decompressor 5 were the same as those of the Example 3 described in Table 3.

Further, each of (i) to (ix) in Tables 1, 2, and 4 corresponds to the position of (i) to (ix) in FIG. 3, respectively. Each of (i) to (x) in Table 3 corresponds to the position of (i) to (x) in FIG. 1, respectively. Each of (i) to (xiii) in Table 5 corresponds to the position of (i) to (xiii) in FIG. 4, respectively.

The conditions at the inlet ((i) in FIGS. 1, 3, and 4) and the outlet ((ii) in FIGS. 1, 3, and 4) of the heat exchanger in the natural gas system (liquefaction line) were the same in each of the Examples (FIGS. 1 and 4), each of the Comparative Examples and the Reference Example (FIG. 3).

Evaluation Results

Reference Example (Table 1)

Under the conditions of the Reference Example (pressure at the inlet of the expansion turbine: 11.1 MPa) using the conventional gas liquefaction method shown in Table 1, as described above, the power consumption was the smallest. As shown in Table 1, in the Reference Example using the liquefaction method with the conventional natural gas liquefaction device 100, the pressure at the outlet ((viii) in FIG. 3) of the decompressor 105 was 1.3 MPa at which the boiling point of nitrogen (refrigerant) was −165° C. in order to cool the natural gas to −163° C.

As shown in Table 1, in the Reference Example, when the pressure at the outlet ((iii) in FIG. 3) of the compressor 102 was 6.1 MPa, and the pressure at the inlet ((v) in FIG. 3) of the expansion turbine 103 was lowered to 11.1 MPa, the power consumption of the compressor 102 became 4660 kw.

When the temperature at the inlet of the expansion turbine 103 increased, the enthalpy difference between at the inlet and the outlet of the expansion turbine increased, and the flow rate of the expansion turbine 103 decreased. On the other hand, since the temperature at the outlet became high, the amount of heat for cooling from that temperature to −163° C. increased, and the flow rate of the decompressor 105 increased. Further, the cooling curve and the heating curve in the heat exchanger 104 came close to each other, and the temperature difference became small.

Due to such contradictory changes in the flow rates of the expansion turbine 103 and the decompressor 105 with respect to the temperature at the inlet of the expansion turbine 103, the total flow rate, that is, the power consumption of the compressor 102, became a minimum at a predetermined inlet temperature.

With the pressures in the Reference Examples shown in Table 1, the power consumption was minimized at −29° C., which was the highest temperature at the inlet in a range in which the temperature difference of the heat exchanger 104 could be secured. Based on this result, in the evaluation results of the following Reference Example (Table 2), Examples and Comparative Examples, the device was operated by determining the temperature at the inlet of the expansion turbine so that the power consumption of the compressor was minimized at each pressure. The results will be described.

Further, in each Reference Example, Examples, and Comparative Examples, the flow rate, the pressure at the inlet and the outlet, and the power consumption of the compressor are values uniquely calculated when the conditions of the expansion turbine and the decompressor are determined, and cannot be arbitrarily selected. That is, the pressure at the inlet of the compressor depends on the pressure at the outlet of the expansion turbine and the decompressor. The flow rate of the compressor is determined by the value which can liquefy the natural gas under the conditions of the expansion turbine and the decompressor at that time. The pressure at the outlet of the compressor, that is, the pressure at the inlet of the braking blower depends on the amount of the refrigerant compressed by the braking blower by the power generated in the expansion turbine at that time. The power consumption is calculated from each of these conditions.

The efficiency of the compressor and expansion turbine, and the pressure loss of each of the lines were the same in all of Reference Example, Examples, and Comparative Examples.

Reference Example (Table 2)

In the Reference Example shown in Table 2 (pressure at the inlet of the expansion turbine: 7.2 MPa), in the natural gas liquefaction method using the conventional natural gas liquefaction device 100, the pressure at the outlet ((viii) in FIG. 3) of the decompressor 105 remained 1.3 MPa, which was the same as that of the Reference Example shown in Table 1, and the pressure at the inlet ((v) in FIG. 3) of the expansion turbine 103 was lowered to 7.2 MPa.

In the Reference Example shown in Table 2, compared with the Reference Example shown in Table 1, it was possible to lower the design pressure at the outlet of the compressor 102, and the design pressure of the heat exchanger 104 could also be lowered, so that the possibility of miniaturization of the device also increased. However, in the case of the Reference Example shown in Table 2, the expansion ratio of the expansion turbine 103 became small and the flow rate increased. Further, since the temperature of the outlet ((vi) in FIG. 3) of the expansion turbine 103 rose, the amount of heat for cooling from this temperature to −163° C. increased, so the flow rate in the pressure-reducing valve 105 also increased. Therefore, in the Reference Example shown in Table 2, the power consumption of the compressor 102 increased to 4970 kw.

Example 2 (Table 3)

In Example 2, in the natural gas liquefaction method using the natural gas liquefaction device 10 according to the present invention, the pressure at the outlet ((vi) in FIG. 1) of the expansion turbine was set to 0.6 MPa. As shown in Table 3, the pressure at the inlet ((v) in FIG. 1) of the expansion turbine 3 was set to 7.2 MPa, which was the same as that of the Reference Example shown in Table 2. As shown in Table 3, the pressure at the outlet ((iii) in FIG. 1) of the compressor 2 was 3.6 MPa, and the pressure at the inlet ((v) in FIG. 1) of the expansion turbine 3 was 7.2 MPa. These pressures were equal to or lower than those of the Reference Examples shown in Table 2. As a result, it was confirmed that, similarly to the above, there was a high degree of freedom in device selection, a high-efficiency heat exchanger such as an aluminum plate fin-type could be adopted, and the device could be downsized. It was also confirmed that the power consumption was reduced by 2.0% from the Reference Example shown in Table 2 and improved to 4870 kW.

Example 2 shown in Table 3 and the Reference Example shown in Table 2 are the same in that the pressure at the outlet ((viii) in FIG. 1) of decompressor 5 was 1.3 MPa. However, the Example 2 and the Reference Example shown in Table 2 are different in that the pressure at the outlet ((vi) in FIG. 1) of the expansion turbine 3 was 1.3 MPa due to the structure of the device, whereas in Example 2, the pressure at the outlet ((vi) in FIG. 1) of the expansion turbine 3 could be reduced to 0.6 MPa. Therefore, in Example 2, the expansion ratio could be increased, and the flow rate could be reduced. Further, in Example 2, since the temperature at the outlet of the expansion turbine 3 was lowered, the amount of heat for cooling with the refrigerant discharged from the decompressor 5 was reduced and the flow rate was also reduced.

In Example 2, the refrigerant (nitrogen) discharged from the expansion turbine 3 was compressed by the compressor 2 from 0.6 MPa to 3.6 MPa. Therefore, compared with the case of the Reference Example shown in Table 2, the compression ratio for compressing the refrigerant in the expansion turbine was larger, but the flow rate was reduced. In Example 2, the pressure of the refrigerant at the outlet of the decompressor 5 was the same as that of the Reference Example. Therefore, the compression ratio for compressing the refrigerant in the decompressor was the same as in Table 2, and the flow rate decreased. In Example 2, the power consumption was reduced by these comprehensive actions.

In Example 2, the flow rate ((x) in FIG. 1) of the refrigerant returning from the compressor 5 to the compressor 2 was small. Since the flow rate of the compression stage 2A ((ix) in FIG. 1) occupied about 93% with respect to the flow rate of the compression stages 2B to 2D ((iii) in FIG. 1), the difference between the compression stages 2A to 2D was small. These compression stages 2A to 2D could be easily designed as an integral compressor 2.

Further, since the decompressor 5 was a JT valve, it could be applied to a small-scale device with a small flow rate.

On the other hand, in Example 2, as compared with the Reference Example shown in Table 1, the pressure of the refrigerant from the compressor to the decompressor was low, so the nature of the refrigerant (nitrogen) inside the heat exchanger was different between Example 2 and the Reference Example. For this reason, the power consumption was slightly higher in Example 2. However, in Example 2, the design pressure at the outlet of the compressor 102 could be lowered, and the design pressure of the heat exchanger 4 could also be lowered. Therefore, there was an advantage that a highly efficient heat exchanger could be adopted. In addition, the power consumption was smaller than that of the Reference Example shown in Table 2 in which the same advantage could be obtained.

Therefore, in Example 2, it is clear that the power consumption could be reduced in the range of the relatively low refrigerant pressure, and further, both the downsizing of the device and excellent cooling performance could be realized. Example 2 had an advantage over the Reference Example.

Comparative Example 2 (Table 4)

In Comparative Example 2 shown in Table 4, in the natural gas liquefaction method using the conventional natural gas liquefaction device 100, the pressure at the outlet of the expansion turbine ((vi) in FIG. 3) was set to 0.6 MPa as in Example 2 shown in Table 3.

In Comparative Example 2, as shown in Table 4, the pressure at the inlet ((v) in FIG. 3) of the expansion turbine was set to 7.2 MPa, as in Example 2.

As shown in Table 4, in Comparative Example 2, the flow rate of the refrigerant (nitrogen) was a value close to the flow rate in Example 2 shown in Table 3. However, the power consumption of the compressor 102 was 4960 kW, which was larger than the value shown in Table 3. This is because, in Comparative Example 2, the pressure at the outlet of the decompressor 105 was 0.6 MPa, which was lower than 1.3 MPa in Example 2, so that the power consumption for compressing the refrigerant introduced from the decompressor 105 to the compressor 102 increased.

Relationship Between Pressure at Inlet of Expansion Turbine and Power Consumption of Compressor As in the Reference Example shown in the graph of FIG. 2, when the minimum power consumption is pursued without limiting the pressure, it is optimal to use a conventional natural gas liquefaction method to bring the pressure at the outlet of the expansion turbine to 1.3 MPa as shown in Table 1 above.

Further, as is clear by comparing the configuration according to the present invention shown in FIG. 1 and the conventional configuration shown in FIG. 3, even when the natural gas liquefaction method according to the present invention was used, theoretically the same low power consumption as in Table 1 could be obtained by setting the pressure at the outlet of the expansion turbine to 1.3 MPa.

On the other hand, when the pressure of the refrigerant was reduced for practical use, for example, when the pressure at the inlet of the expansion turbine was 9 MPa or less, as shown in FIG. 2 of the Example 1, the power consumption could be reduced to the level equal to or lower than that of the Reference Example by using the natural gas liquefaction device and method according to the present invention and setting the pressure at the outlet of the expansion turbine to 0.9 MPa.

Furthermore, for example, when the pressure at the inlet of the expansion turbine was reduced to about 6 MPa, the power consumption could be reduced compared with Reference Example and Example 1 by setting the pressure at the outlet of the expansion turbine to 0.6 MPa, as in Example 2 shown in Table 3.

It is clear from the explanation above that even when the pressure at the inlet of the expansion turbine is higher than 9 MPa, it is possible to reduce the power consumption as compared with the Reference Example by using the natural gas liquefaction method according to the present invention and setting the pressure at the outlet of the expansion turbine to an appropriate pressure within a range of 0.9 to 1.3 MPa. However, detailed explanation and illustration of this case are omitted because the degree of reduction in power consumption is small, and the reduction in the power consumption by lowering the refrigerant pressure to reduce the size of the device, which is the object of the present invention, cannot be achieved.

Further, comparing Example 1 with Comparative Example 1 and comparing Example 2 with Comparative Example 2, which are shown in the graph of FIG. 2, when the pressure at the inlet and the pressure at the outlet of the expansion turbine are the same, it can be found that Examples 1 and 2 according to the present invention always consumed less power than Comparative Examples 1 and 2 using the conventional natural gas liquefaction method. This is because, as described above, in the Comparative Examples, when the pressure at the outlet of the expansion turbine is lowered, the pressure at the outlet of the JT valve is unnecessarily lowered.

Further, by comparing Example 2 shown in Table 3 with Example 3 shown in Table 5, it can be found that when the pressure at the inlet and the pressure at the outlet of the expansion turbine are the same, the power consumption of the Example 3 is smaller. In Example 2, the total amount of the refrigerant returning from the decompressor to the compressor through the heat exchanger was 1.3 MPa ((x) in Table 3), whereas in Example 3, two decompressors were provided and a part of the refrigerant was returned into the compressor at 1.3 MPa ((x) in Table 5) and the residue was returned into the compressor at 2.6 MPa ((xiii) in Table 5). In order to cool the natural gas to −160° C., it is necessary to reduce the pressure of some of the refrigerant to 1.3 MPa, which is the same as in Example 2, also in Example 3. However, the boiling point of the residual refrigerant that cools only the higher temperature region may be higher than that, so that the pressure can be higher than 1.3 MPa. Since the higher the pressure is, the smaller the latent heat of vaporization is, the amount of the refrigerant passing through the decompressor for cooling the natural gas to −160° C. is larger in Example 3 (total of (vii) and (xi) in Table 5) than in Example 2 ((vii) in Table 3). However, since the effect of returning a part of the refrigerant into the compressor at a pressure higher than 1.3 MPa is great, the power consumption of Example 3 could be further reduced as compared with Example 2.

Since the natural gas is liquefied in the range of −50° C. to −100° C., which is higher than the temperature of the refrigerant-3, a large amount of heat is required to cool this range. On the other hand, the amount of heat required in the region cooled by the decompressor, which is lower than that of the refrigerant-3, is relatively small.

Therefore, especially for small-scale equipment, there is a relatively small difference in effectiveness between the method of providing multiple decompressors in this region and the method of providing another expansion turbine instead of the decompressor at a higher cost to reduce the power consumption. Therefore, the former can also be a reasonable option in terms of cost effectiveness.

Explanation of FIG. 2

FIG. 2 is a graph which shows a relationship between the pressure at the inlet ((v) in FIGS. 1 and 3) of the expansion turbine and the power consumption of the compressor in Examples 1 and 2, Comparative Examples 1 and 2, and Reference Example.

As shown in the results of Example 2, it can be understood that when the pressure on the outlet side ((vi) in FIG. 1) of the expansion turbine was set to a low pressure of 0.6 MPa, the power consumption when the inlet side pressure was about 6 MPa could be reduced to approximately 4,900 kW or less.

As shown in the results of Example 1, when the pressure at the outlet of the expansion turbine was set slightly higher, 0.9 MPa, the power consumption when the pressure at the inlet was approximately 7 to 9 MPa could be reduced to approximately 4,800 kW or less, which means that the power consumption could be reduced.

When the pressure at the outlet of the expansion turbine was set to 1.3 MPa, which was a comparatively high level, as in the conventional natural gas liquefaction device and method, the power consumption was low when the pressure at the inlet was approximately 9 to 10 MPa. Therefore, if there is no restriction on the pressure specification, it is possible to reduce the power consumption even with the conventional natural gas liquefaction device and method. However, as in the present embodiment, in particular, for the purpose of downsizing the heat exchanger while ensuring cooling performance, for example, when a heat exchanger made of a thin material, specifically, a plate fin-type heat exchanger is used, it is required to operate at a relatively low refrigerant pressure. As described above, when the pressure at the inlet of the expansion turbine is relatively low, that is, when the pressure is less than 9 MPa as shown in FIG. 2, particularly in a range of 6 MPa or more and less than 9 MPa, it is clear that the natural gas liquefaction device and method of the present embodiment can be operated with lower power consumption than the conventional natural gas liquefaction device and method, which are the Reference Example, and Comparative Examples 1 and 2.

From the results of the Examples above, the natural gas liquefaction device and the natural gas liquefaction method according to the present invention can reduce the power consumption in the range of a relatively low refrigerant pressure, and both device miniaturization and excellent cooling performance can be achieved.

INDUSTRIAL APPLICABILITY

The natural gas liquefaction device and the natural gas liquefaction method of the present invention use noncombustible gas as a refrigerant, and can reduce the power consumption in the range of a relatively low refrigerant pressure. Therefore, for example, the natural gas liquefaction device and the natural gas liquefaction method according to the present invention are also very suitable as a small-scale natural gas liquefaction device including only one expansion turbine, and a liquefaction method using the same.

EXPLANATION OF REFERENCE NUMERAL

10 natural gas liquefaction device
1 nitrogen source
2 compressor
2A, 2B, 2C, 2D compression stage (multiple compression stages)
21A, 21B, 21C, 21D cooler
3 expansion turbine
31 braking blower
32 cooler
4 heat exchanger
5 decompressor
6 natural gas supply source
7 precooler
8 storage tank
L1 first refrigerant line
L2 second refrigerant line
L3 third refrigerant line
L4 fourth refrigerant line
FL liquefaction line
G natural gas
F liquefied natural gas (LNG)
P branched point (first refrigerant line)

The invention claimed is:

1. A natural gas liquefaction device which produces a liquefied natural gas by cooling and liquefying a natural gas, wherein the natural gas liquefaction device includes:

a compressor which is configured to compress a refrigerant containing noncombustible gas by a plurality of compression stages;

a heat exchanger which is configured to cool and liquefy a natural gas to be a liquefied natural gas;

a natural gas liquefaction line which is configured to introduce the natural gas into the heat exchanger and supply the liquefied natural gas liquefied in the heat exchanger to an outside of the natural gas liquefaction device;

a first refrigerant line which is configured to introduce a refrigerant-1 compressed by the compressor into the heat exchanger, and further introduce the refrigerant-1 passed through the heat exchanger into a pressure-reducing valve;

a second refrigerant line which is configured to introduce a refrigerant-2 which is decompressed by the pressure-reducing valve into the heat exchanger to cool the liquefied natural gas, and introduce the refrigerant-2 passed through the heat exchanger into any one stage except a first stage of the plurality of compression stages provided in the compressor;

a third refrigerant line which is branched from the first refrigerant line and is configured to introduce at least a part of the refrigerant-1 into an expansion turbine; and a fourth refrigerant line which is configured to introduce a refrigerant-3 expanded by the expansion turbine into the heat exchanger, and introduce the refrigerant-3 passed through the heat exchanger into the first compression stage of the plurality of compression stages provided in the compressor;

wherein the second refrigerant line and the pressure reducing valve are configured so that the refrigerant-2 has a higher pressure and a lower temperature than the refrigerant-3 and so that the flow rate of the refrigerant-2 is less than 10% of a total flow rate of the entire refrigerant.

2. The natural gas liquefaction device according to claim 1, wherein the natural gas liquefaction device further includes a braking blower which is provided in the first refrigerant line, configured to be driven by the expansion turbine, and compress the refrigerant-1 flowing through the first refrigerant line.

3. The natural gas liquefaction device according to claim 1, wherein the heat exchanger is an aluminum plate fin-type heat exchanger including serrated fin-type fins or herring-bone fin-type fins.

4. The natural gas liquefaction device according to claim 1, wherein the natural gas liquefaction device further includes a precooler which is provided on an inlet side of the heat exchanger in the natural gas liquefaction line and configured to cool the natural gas with a vaporization type refrigerant.

5. The natural gas liquefaction device according to claim 1, wherein the heat exchanger comprises a plurality of heat exchanging parts arranged in series, the heat exchanging parts comprising a heat exchanging part configured to receive the refrigerant-3 and a heat exchanging part configured to not receive the refrigerant-3.

6. The natural gas liquefaction device according to claim 1, wherein the pressure-reducing valve is one of a plurality of pressure-reducing valves of the natural gas liquefaction device and the second refrigerant line is one of a plurality of second refrigerant lines of the gas liquefaction device, wherein each of the plurality of the second refrigerant lines has a different starting point of the refrigerant flow at a respective one of the plurality of pressure reducing valves and different ending points of the refrigerant flow at different compression stages, the different compression stages consisting of a second compression stage and the subsequent stages.

7. A natural gas liquefaction method for producing a liquefied natural gas by cooling and liquefying a natural gas, including:

a natural gas supply step of introducing a natural gas into a heat exchanger, and supplying a liquefied natural gas cooled and liquefied by the heat exchanger to an outside of a natural gas liquefaction device; and a refrigerant supply step of introducing a refrigerant containing noncombustible gas for cooling the natural gas introduced into the heat exchanger wherein the refrigerant supply step comprises:

a refrigerant supply step a of compressing the refrigerant by a compressor having a plurality of compression stages, introducing and passing the refrigerant through the heat exchanger to produce a refrigerant-1, and introducing the refrigerant-1 into a pressure-reducing valve;

a refrigerant supply step b of decompressing and reducing a temperature of the refrigerant-1 by the pressure reducing valve to produce a refrigerant-2 and at least a part of which is in the liquid phase and for cooling the liquefied natural gas, introducing the refrigerant-2 into the heat exchanger to be heated, and introducing the refrigerant-2 into any one of the plurality of compression stages except a first compression of the plurality of compression stages provided in the compressor;

a refrigerant introducing step c of introducing at least a part of the refrigerant-1 compressed in the refrigerant supply step a into an expansion turbine; and a refrigerant supplying step d of expanding and reducing in pressure and temperature of the refrigerant-1 by the expansion turbine to produce a refrigerant-3 for cooling and liquefying the natural gas and introducing the refrigerant-3 through the heat exchanger and so that the refrigerant-3 is heated, and introducing the refrigerant-3 into the first compression stage of the plurality of compression stages provided in the compressor, wherein the refrigerant-2 has a higher pressure and a lower temperature than the refrigerant-3, and the flow rate of the refrigerant-2 is less than 10% of a total flow rate of the entire refrigerant.

8. The natural gas liquefaction method according to claim 7, wherein pressure on the inlet side of the expansion turbine in the refrigerant supply step a is less than 9 MPa.

9. The natural gas liquefaction method according to claim 7, wherein the refrigerant supply step a further includes a step of further compressing the refrigerant-1 compressed in multiple stages in the compressor using power generated by the expansion turbine.

10. The natural gas liquefaction method according to claim 7, wherein the natural gas supply step further includes a step of precooling the natural gas by a vaporization type refrigerant before being introduced into the heat exchanger.

11. The natural gas liquefaction method according to claim 7, wherein the heat exchanger comprises a plurality of heat exchanging parts arranged in series, the heat exchanging parts comprising a heat exchanging part configured to receive the refrigerant-3 and a heat exchanging part configured to not received the refrigerant-3.

12. The natural gas liquefaction method according to claim 7, wherein the pressure reducing valve is one of a plurality of pressure reducing valves and the refrigerant is supplied into the plurality of pressure reducing valves in the refrigerant supply step, and the refrigerant supply step b has different starting points of the refrigerant flow at different pressure reducing valves and different ending points of the refrigerant flow at different compression stages of a second compression stage and the subsequent stages.

* * * * *